US006032421A

United States Patent [19]

Yamada

[11] Patent Number: 6,032,421

[45] Date of Patent: Mar. 7, 2000

[54] STRUCTURAL BLOCKS FOR BUILDING A BASEMENT, BLOCK MANUFACTURING METHOD, BLOCK TRANSPORTING METHOD, AND BLOCK INSTALLING METHOD

[76] Inventor: Susumu Yamada, 167, Oazaminoura, Ohmi-cho, Sakata-gun, Shiga-ken, Japan

[21] Appl. No.: 08/970,137

[22] Filed: Nov. 13, 1997

[30] Foreign Application Priority Data

Nov. 28, 1996 [JP] Japan ..... 8-318254
Apr. 14, 1997 [JP] Japan ..... 9-096105

[51] Int. Cl.[7] ..... E04H 1/00; E04B 1/348

[52] U.S. Cl. ..... 52/79.8; 52/79.1; 52/79.9; 52/79.14; 52/169.6; 52/169.7; 52/169.14; 52/293.2; 52/294; 52/298; 405/135; 220/4.26

[58] Field of Search ..... 52/79.7, 79.8, 52/79.9, 79.13, 79.14, 79.3, 79.1, 19, 20, 21, 169.6, 169.7, 169.8, 169.14, 250, 292, 293.2, 298, 294; 405/133, 134, 135; 220/4.26, 567.1

[56] References Cited

U.S. PATENT DOCUMENTS

| | | | |
|---|---|---|---|
| 1,422,674 | 7/1922 | Cook | 52/20 X |
| 2,350,018 | 5/1944 | Dean et al. | 52/20 X |
| 3,201,907 | 8/1965 | Henderson | 52/79.7 X |
| 3,263,378 | 8/1966 | Dorris | 52/20 |
| 3,438,157 | 4/1969 | Monica | 52/20 |
| 3,562,969 | 2/1971 | Little, Jr. | 52/20 |
| 3,704,564 | 12/1972 | Koga | 52/747.12 |
| 3,891,224 | 6/1975 | Ditcher | 52/21 X |
| 4,250,671 | 2/1981 | Hirsch et al. | 52/167.3 |
| 4,539,780 | 9/1985 | Rice | 52/169.6 |
| 5,081,802 | 1/1992 | Westhoff et al. | 52/20 |
| 5,168,682 | 12/1992 | Rye | 52/19 X |
| 5,495,695 | 3/1996 | Elliott, Jr. | 52/20 |

FOREIGN PATENT DOCUMENTS

| | | | |
|---|---|---|---|
| 1051320 | 2/1957 | France | 52/79.3 |
| 2560904 | 9/1985 | France | 52/20 |
| 2617504 | 11/1977 | Germany | 52/79.1 |
| 2705385 | 8/1978 | Germany | 52/79.1 |
| 57-110150 | 12/1955 | Japan . | |
| 59-40414 | 3/1984 | Japan . | |
| 59-210128 | 11/1984 | Japan | 52/169.6 |
| 60-0144655 | 9/1985 | Japan . | |
| 60-199122 | 10/1985 | Japan . | |
| 63-165003 | 10/1988 | Japan . | |
| 3-76933 | 4/1991 | Japan | 52/169.6 |
| 4-203117 | 7/1992 | Japan . | |
| 5-93436 | 4/1993 | Japan | 52/79.1 |
| 7-12438 | 3/1995 | Japan . | |
| 8-120954 | 5/1996 | Japan . | |

*Primary Examiner*—Laura A. Callo
*Attorney, Agent, or Firm*—Jordan and Hamburg LLP

[57] ABSTRACT

A basement unit comprises a reinforced concrete lower structural block having a floor portion and surrounding walls and at least one reinforced concrete upper structural block having surrounding walls and the same shape as the lower structural block in plan view. The upper structural block is stacked on top of the lower structural block with a seal member placed between the top end of the lower structural block and the bottom end of the upper structural block.

29 Claims, 24 Drawing Sheets

STRUCTURAL BLOCKS FOR BUILDING A BASEMENT, BLOCK MANUFACTURING METHOD, BLOCK TRANSPORTING METHOD, AND BLOCK INSTALLING METHOD

BACKGROUND OF THE INVENTION

The present invention relates to reinforced concrete blocks for building a basement, which may be used as a habitable space or a storage space, as well as methods of manufacture, transport and on-site installation of the reinforced concrete blocks.

There is a growing tendency in recent years to build basement rooms in ordinary houses to achieve efficient use of limited site areas. A conventional method of on-site basement construction involves the steps of building forms into which concrete is poured, arranging reinforcing bars in the forms, pouring concrete into the forms, and subsequent curing of the concrete which requires a longer period of time than the preceding steps. The conventional method of basement construction is much complicated as described above, requiring not only considerable manpower and costs but also a long time for completion. Such limitations have thus far prevented the proliferation of basement construction.

To overcome the aforementioned problem, Japanese Unexamined Patent Publication Nos. 3-76933, 8-92973 and 8-92974, for example, disclose unit-type basement structures which enable mass production of basement blocks. According to the disclosure of these Publications, reinforced concrete basement blocks, having standardized dimensions for ease of transportation and handling, are mass-produced in a factory. These concrete blocks are transported to a construction site and placed side by side and joined together in an already excavated pit to form a complete basement unit. Since this procedure eliminates the need for on-site concrete placing and associated work, it is possible to reduce construction costs and shorten the time for completion.

In the unit-type basement structure disclosed in Japanese Unexamined Patent Publication No. 3-76933, each basement unit is formed by joining a plurality of horizontally divided, or vertically cut, concrete blocks. A major problem encountered with this structure is that it is difficult to prevent intrusion of groundwater through vertical joints between adjacent concrete blocks. An approach used in the structure of this Patent Publication for solving this problem is as follows. Each of the boxlike concrete blocks, each having one or two open ends, has holes formed along four horizontal edges for passing wires. After placing these concrete blocks side by side with seal members sandwiched in between, the wires are passed through the holes from one extreme end of the basement unit to the other and tightened to securely hold the individual concrete blocks and thereby prevent water intrusion through the joints between the adjacent concrete blocks. Provision of such holes for passing the wires for binding the plurality of concrete blocks would however cause an increase in production costs. Furthermore, the wires binding the concrete blocks could stretch or corrode in a long period of time, resulting in a reduction in their binding force and eventual water intrusion through gaps formed between the individual concrete blocks.

In Japanese Unexamined Patent Publication Nos. 8-92973 and 8-92974, each basement unit is divided into smaller concrete blocks than that disclosed in Japanese Unexamined Patent Publication No. 3-76933. While block-to-block connections are achieved by using metallic joint fixtures which are embedded in the individual concrete blocks (especially in Patent Publication No. 8-92973), the structures have the same groundwater intrusion problem as the basement unit of Japanese Unexamined Patent Publication No. 3-76933. Further, the basement unit structures of Japanese Unexamined Patent Publication Nos. 8-92973 and 8-92974 are disadvantageous for providing a shortened construction period, because the floor of the basement unit is formed by use of a conventional on-site concrete placing method.

In addition, the aforementioned Patent Publications are directed solely to the construction of a single basement room, without disclosing any idea about producing basement spaces of varying shapes which could potentially be realized by combining multiple basement units. Japanese Unexamined Patent Publication No. 4-44526, on the other hand, discloses a construction method for creating multiple basement rooms by assembling precast concrete panels on-site. However, the method of this Patent Publication requires rather complicated on-site installation work, making it difficult to shorten the construction period.

An approach to the solution of the above problem would be to produce multiple basement rooms by placing a plurality of basement units which are already connected side by side in an underground space. This would however develop a new problem that rainwater or groundwater could intrude into the interior of the basement rooms through joints between door openings of the adjacent basement units. The adjacent basement units could be secured to each other by binding them together with ropes or by using bolts and nuts, or tie rods, to eliminate gaps between them in an attempt to solve this problem. Even when such measures are taken, however, connections between the adjacent basement units are likely to loosen and gaps can develop between them after an extended period of time, eventually causing water intrusion. The above approach toward the construction of multiple basement rooms, involving the use of already connected basement units, is therefore unsatisfactory from a long-term point of view.

SUMMARY OF THE INVENTION

It is an object of the invention to provide a basement structure which has overcome the problems residing in the prior art.

According to an aspect of the invention, a basement structure comprises a reinforced concrete lower structural block having a floor portion and surrounding walls, and at least one reinforced concrete upper structural block having surrounding walls and the same shape as the lower structural block in plan view, the upper structural block being stacked on top of the lower structural block with a seal member placed between the top end of the lower structural block and the bottom end of the upper structural block.

In the basement structure, each basement unit is divided into separate blocks including one lower structural block and at least one reinforced concrete upper structural block. The basement unit of this structure can be factory-produced even when it is a large-sized one, resulting in a significant reduction in on-site construction costs compared to the conventional basement construction techniques in which the whole basement structure is constructed on-site.

These and other objects, features and advantages of the invention will become more apparent upon reading the following detailed description in conjunction with the accompanying drawings.

DETAILED DESCRIPTION OF THE PREFERRED EMBODIMENTS OF THE INVENTION

Figure 1:
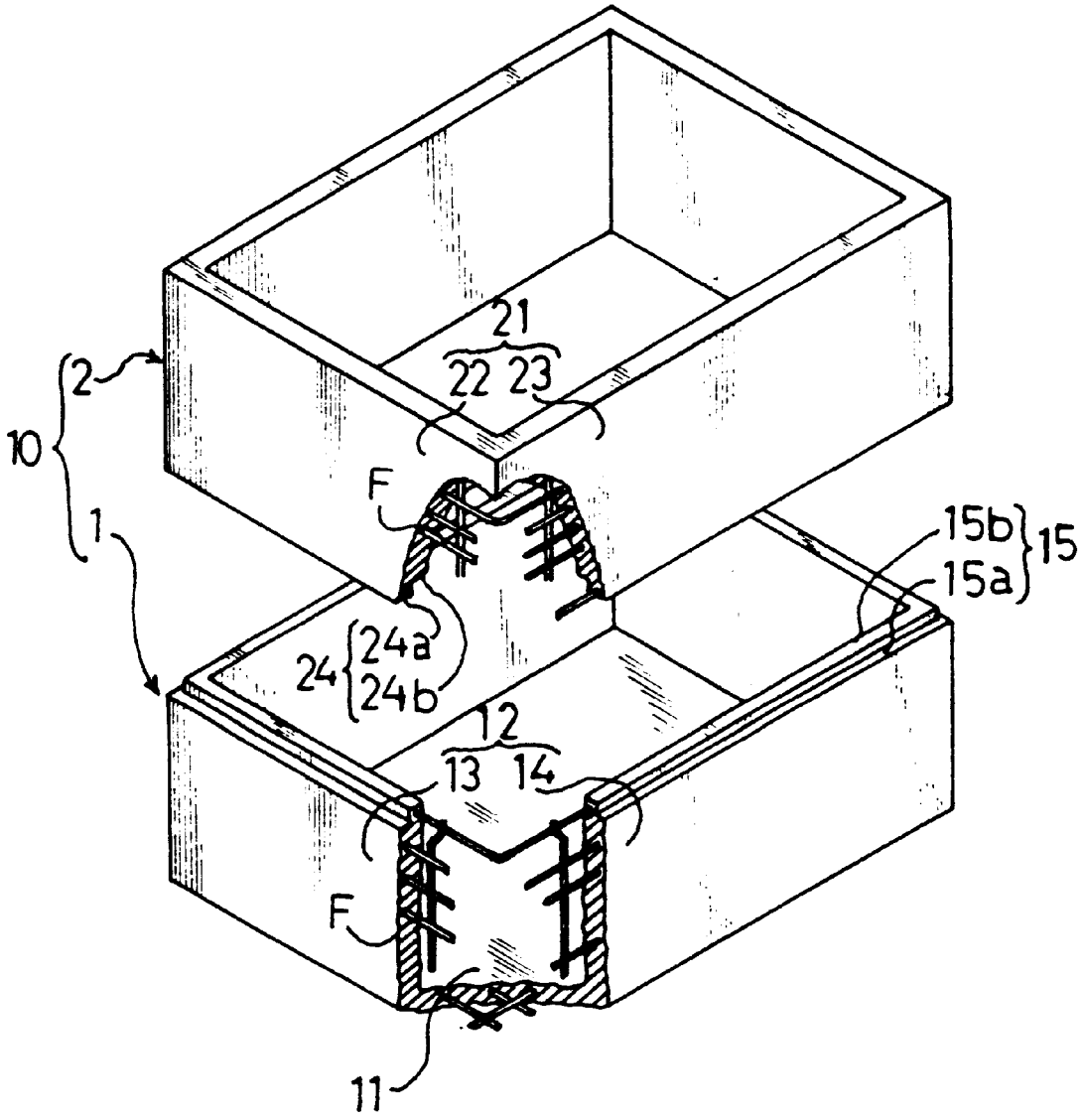
FIG. 1 is a partially cutaway view of upper and lower structural blocks for building a basement according to a first embodiment of the invention.
Figure 2:
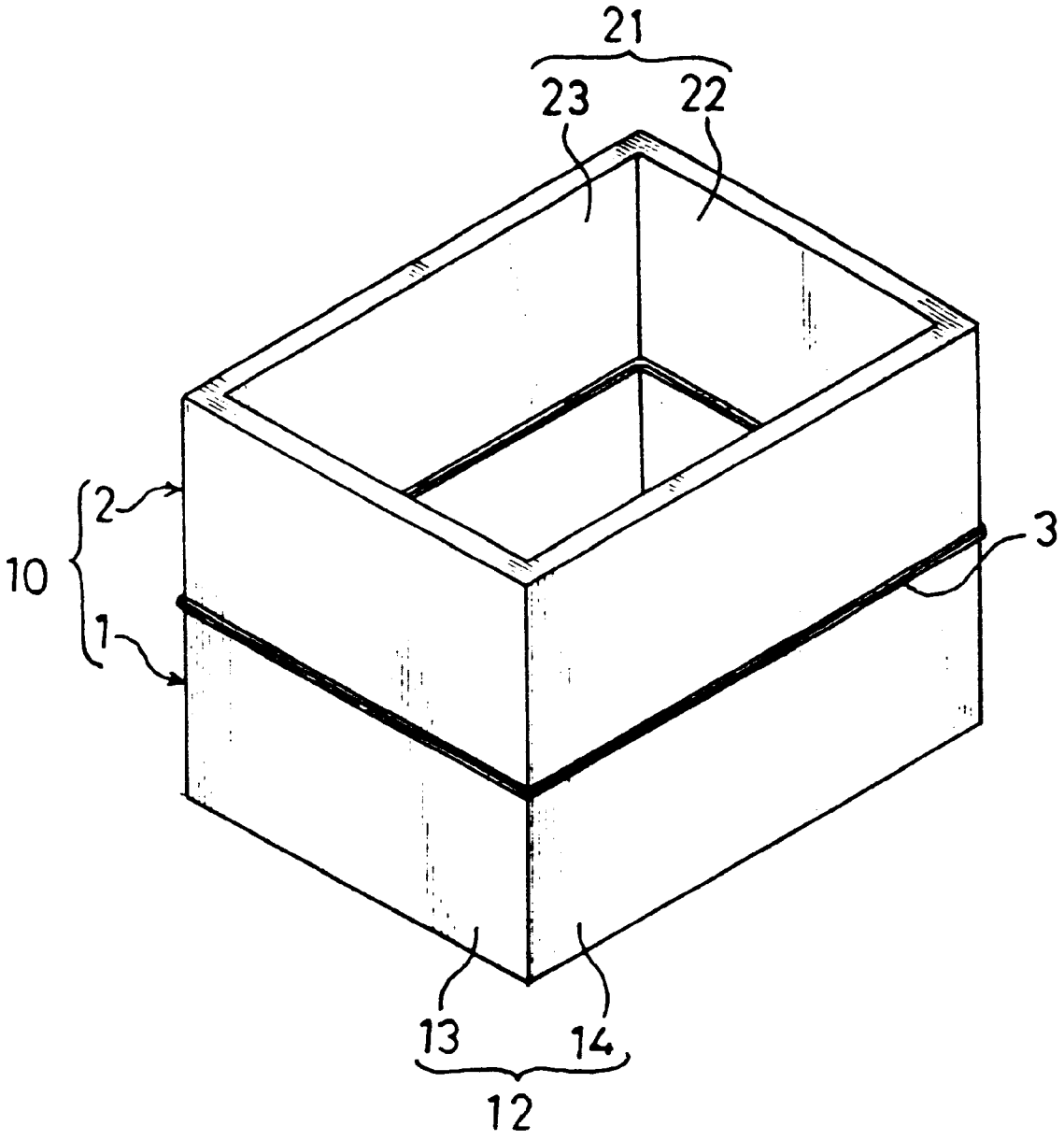
FIG. 2 is a perspective assembly diagram showing how the structural basement blocks of FIG. 1 are assembled with each other.

FIG. 1 is a partially cutaway view of structural blocks for building a basement according to a first embodiment of the invention, and FIG. 2 is a perspective assembly diagram showing how the structural blocks of FIG. 1 are assembled.

As can be seen from these Figures, a basement unit 10 comprises as its principal elements a lower structural block 1 forming a lower half of the basement unit 10 and an upper structural block 2 forming its upper half. Formed into a rectangular shape in plan view, the lower structural block 1 has a floor portion 11 formed at the bottom and surrounding walls 12 extending upward from all sides of the floor portion 11. The floor portion 11 also has a rectangular shape in plan view as illustrated. The surrounding walls 12 of the lower structural block 1 include a pair of short side walls 13 vertically formed from opposite short sides of the floor portion 11 and a pair of long side walls 14 vertically formed from opposite long sides of the floor portion 11. The top of each surrounding wall 12 is shaped to form a stepped end 15 having an outer lower end portion 15*a* and an inner higher end portion 15*b*.

Constructed into the same rectangular shape and dimensions as the lower structural block 1 in plan view, the upper structural block 2 has surrounding walls 21 which also include a pair of short side walls 22 corresponding to the short side walls 13 and a pair of long side walls 23 corresponding to the long side walls 14. The bottom of each surrounding wall 21 is shaped to form a stepped end 24 having an outer lower end portion 24*a* which corresponds to the lower end portion 15*a* of each surrounding wall 12 and an inner higher end portion 24*b* which corresponds to the higher end portion 15*b* of each surrounding wall 12. The basement unit 10 is formed when the upper structural block 2 is stacked on top of the lower structural block 1 in such a way that the bottom surfaces of the surrounding walls 21 of the upper structural block 2 are exactly aligned with and placed in contact with the top surfaces of the surrounding walls 12 of the lower structural block 1.

Figure 3A:
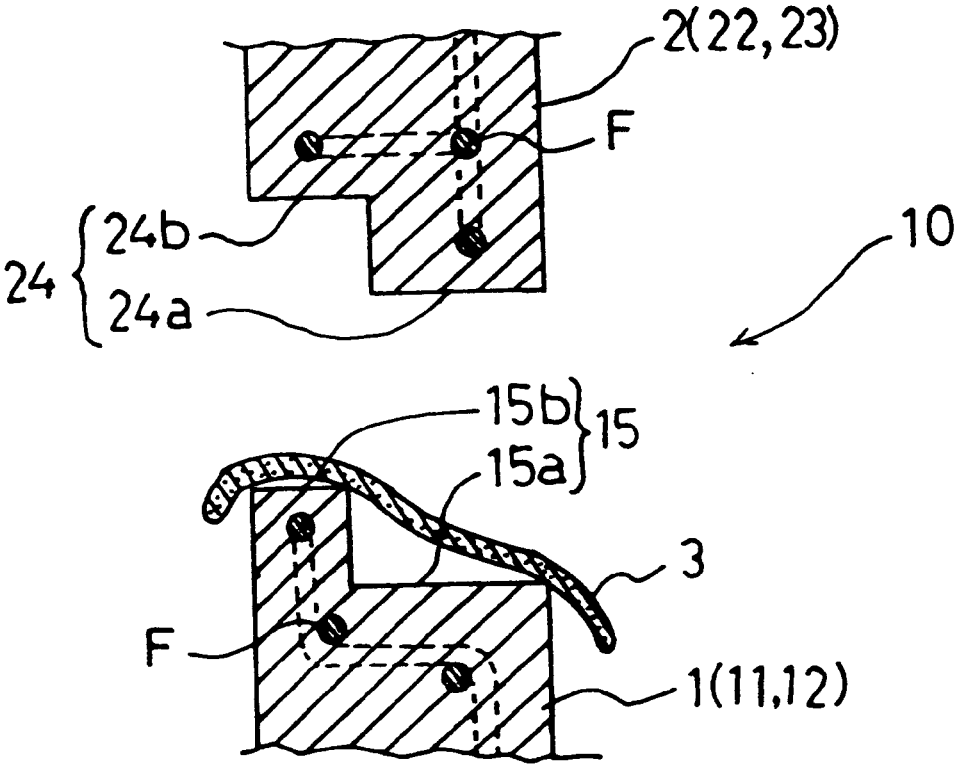
FIGS. 3A and 3B are fragmentary sectional views of stepped ends of the upper and lower structural blocks, FIG. 3A showing a status before the upper structural block is stacked on top of the lower structural block, and FIG. 3B showing a status after the upper structural block has been stacked on the lower structural block.
Figure 3B:
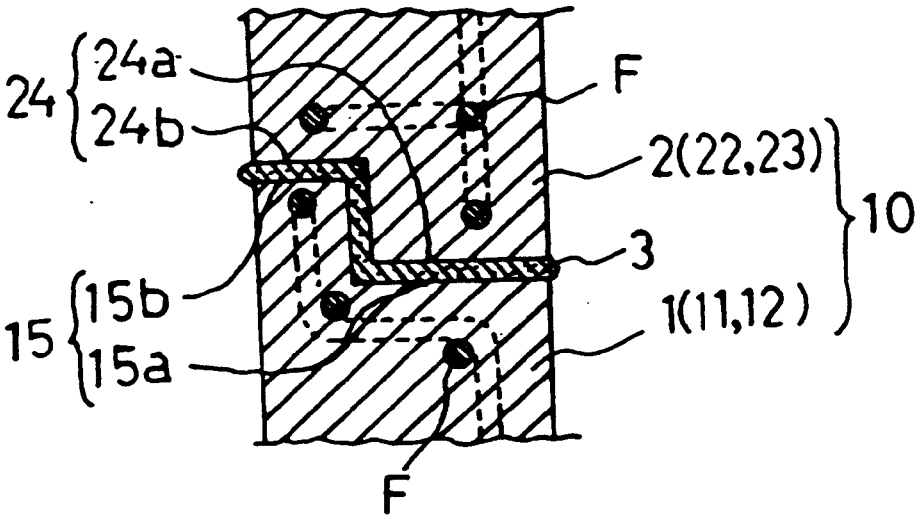

FIGS. 3A and 3B are fragmentary sectional views of the stepped ends 15, 24 of the lower and upper structural blocks 1, 2, FIG. 3A showing a status before the upper structural block 2 is placed on top of the lower structural block 1, and FIG. 3B showing a status after the upper structural block 2 has been placed on the lower structural block 1. As can be seen from FIG. 3A, the higher end portions 24*b* of the surrounding walls 21 are positioned face to face with the higher end portions 15*b* of the surrounding walls 12, and the lower end portions 24*a* of the surrounding walls 21 are positioned face to face with the lower end portions 15*a* of the surrounding walls 12, when the upper structural block 2 is hoisted in position above the lower structural block 1 in a manner that the individual stepped ends 24 of the upper structural block 2 are aligned with the corresponding stepped ends 15 of the lower structural block 1. The widths of the individual lower end portions 15*a*, 24*a* and the higher end portions 15*b*, 24*b* are set so that the stepped ends 24 of the upper structural block 2 engage the corresponding stepped ends 15 of the lower structural block 1 as shown in FIG. 3B when the upper structural block 2 is lowered from the status of FIG. 3A until its stepped ends 24 come in contact with the respective stepped ends 15 of the lower structural block 1. This arrangement ensures that the upper structural block 2, once properly stacked on the lower structural block 1, is not dislocated in horizontal directions.

The lower and upper structural blocks 1, 2 are formed of reinforced concrete containing steel reinforcing bars F which are arranged to form a crisscross pattern and embedded in concrete. Before the upper structural block 2 is stacked on the lower structural block 1, a seal member 3 formed of an elastic material such as rubber having good flexibility and waterproofing performance is placed on the stepped ends 15 of the surrounding walls 12 as shown in FIG. 3A. When the upper structural block 2 is placed on the lower structural block 1, the seal member 3 is tightly pressed by the weight of the upper structural block 2 and held between the stepped ends 15 and 24 of the surrounding walls 12, 21 as shown in FIG. 3B. When the basement unit 10 is thus assembled underground, the seal member 3 prevents intrusion of groundwater from between the joint surfaces of the stepped ends 15, 24.

In this embodiment, the surrounding walls 12, 21 of the individual structural blocks 1, 2 and the floor portion 11 of the lower structural block 1 have a minimum thickness of 150 mm so that an upper part of the upper structural block 2 which would project above the ground level when the basement unit 10 is set in position can serve as a foundation for a structure constructed above the ground.

Each of the reinforcing bars F used in this embodiment measures 13 mm in diameter. The reinforcing bars F include main reinforcing bars arranged parallel to the longitudinal axis of each structural member and distributing bars arranged at right angles to the main reinforcing bars. The distributing bars and the main reinforcing bars are individually laid parallel at specific intervals and assembled at right angles with each other by a conventional procedure, in which the intervals between the distributing bars and between the main reinforcing bars are determined depending on specific applications of the basement unit 10 (e.g., whether the basement unit 10 is used simply as a basement room or intended to serve also as a foundation on which a structure built above the ground rests).

If the lower structural block 1 is placed underground so that the floor portion 11 is located 1.8 to 2.0 m below the ground level, earth pressure acting on the surrounding walls 12 amounts to 1.0 tf/m in normal conditions and 1.7 to 2.0 tf/m during an earthquake on condition that the internal friction angle is 30 degrees when earth backfill is ordinary soil with saturated water content and the lateral seismic coefficient k is 0.3. The aforementioned diameter (13 mm) of the reinforcing bars F has been selected taking these conditions into account, whereby the basement unit 10 can well withstand potential external stresses not only in ordinary conditions but also during earthquakes.

The reinforcing bars F are embedded in the projecting higher end portions 15*b* of the lower structural block 1 and the lower end portions 24*a* of the upper structural block 2 as shown in FIGS. 3A and 3B. With this arrangement, mechanical strength of the higher end portions 15*b* and the lower end portions 24*a* is substantially increased so that inherent weakness of the joint between the lower structural block 1 and the upper structural block 2 is efficiently alleviated.

The width (i.e., the horizontal dimension of the short side walls 13, 22 and the length (i.e., the horizontal dimension of the long side walls 14, 23 ) of the basement unit 10 are set to multiples of 0.9 m external dimensions to match ordinary Japanese houses, for example. Further, the height of the individual structural blocks 1, 2 is set to 1.2 m or 1.3 m so that the height of the basement unit 10 becomes 2.4 m or 2.6 m. In this embodiment, the basement unit 10 can be made to any standardized sizes which may include 4.5-, 8 -and 10 -mat (tatami) sizes, for example, that are suited for factory production. Table 1 below shows dimensional specifications which may be applied to the basement unit 10 of this embodiment.

TABLE 1

| Basement size (No. of floor mats) | Height (m) | Width (m) | Length (m) |
|---|---|---|---|
| 4.5 | 2.4 or 2.6 | 2.7 | 2.7 |
| 6 | " | 2.7 | 3.6 |
| 8 | " | 3.6 | 3.6 |
| 10 | " | 3.6 | 4.5 |

The dimensional specifications of the embodiment shown above should be taken simply as typical examples of the invention. These dimensions have been chosen to provide some typical configurations because they are well suited to ordinary Japanese houses and factory production, and because the individual structural blocks 1, 2 constructed to the above dimensions can be trucked by public roads in compliance with road traffic laws and regulations if the structural blocks 1, 2 are laid on their side.

Figure 4A:
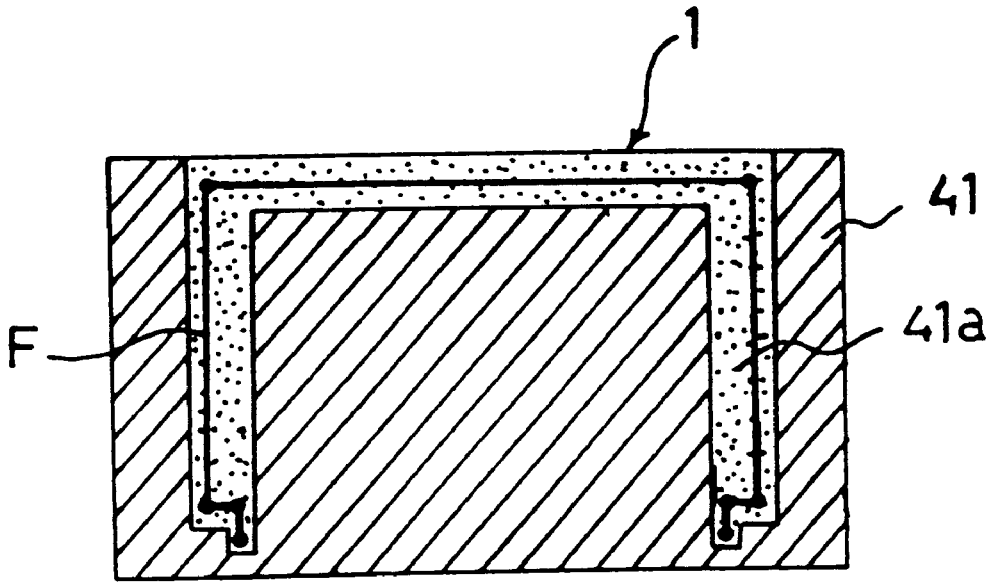
FIGS. 4A and 4B are sectional views illustrating how a basement unit is produced, FIG. 4A showing a status after ready-mixed concrete has been poured into a form for the lower structural block with steel reinforcement already arranged, and FIG. 4B showing a status after ready-mixed concrete has been poured into a form for the upper structural block with steel reinforcement already arranged.
Figure 4B:
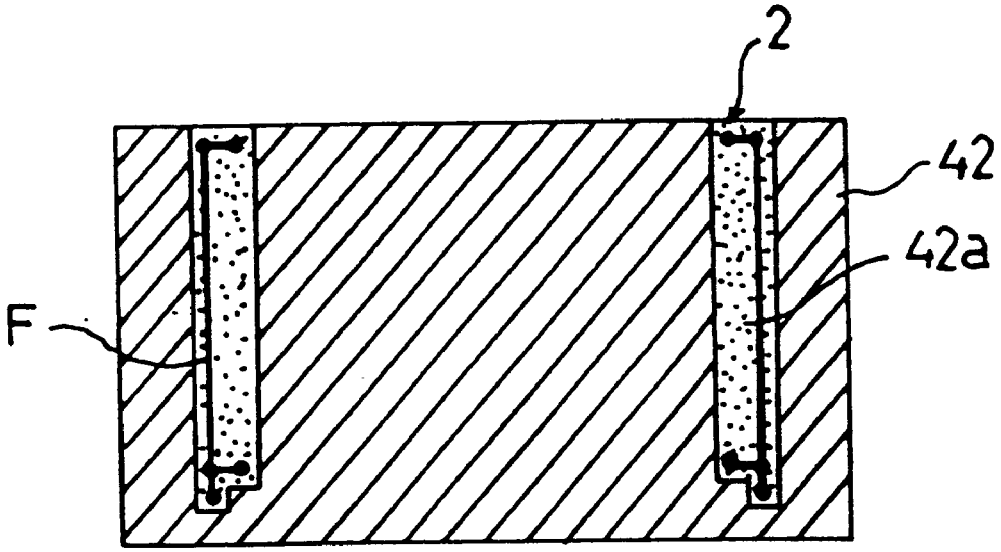

Referring now to FIGS. 4A and 4B, a process of manufacturing the individual structural blocks 1, 2 is described. FIGS. 4A and 4B are sectional views illustrating how the basement unit 10 is produced, FIG. 4A showing a status after ready-mixed concrete has been poured into a form for the lower structural block 1 with steel reinforcement already arranged, and FIG. 4B showing a status after ready-mixed concrete has been poured into a form for the upper structural block 2 with steel reinforcement already arranged.

Designated by the numeral 41 in FIG. 4A is a first form used for producing the lower structural block 1. The first form 41 has a cavity 41*a* having the same, but inverted, three-dimensional shape as the lower structural block 1. After arranging the reinforcing bars F in the cavity 41*a*, ready-mixed concrete is poured into the cavity 41*a* while vibrating the first form 41 by using a form vibrator which is not illustrated. The first form 41 is then left at rest to allow the concrete to set. When the concrete has cured and gained sufficient strength, the newly made lower structural block 1 is removed from the cavity 41*a* of the first form 41. During the process of concrete curing, the concrete may be heated by feeding steam into the first form 41 to accelerate the curing of the concrete.

Designated by the numeral 42 in FIG. 4B is a second form used for producing the upper structural block 2. The second form 42 has a cavity 42*a* having the same non-inverted three-dimensional shape as the upper structural block 2. After arranging the reinforcing bars F in the cavity 42*a*, ready-mixed concrete is poured into the cavity 42*a* and allowed to set until the upper structural block 2 is completed in substantially the same way as the production of the lower structural block 1.

Figure 5A:
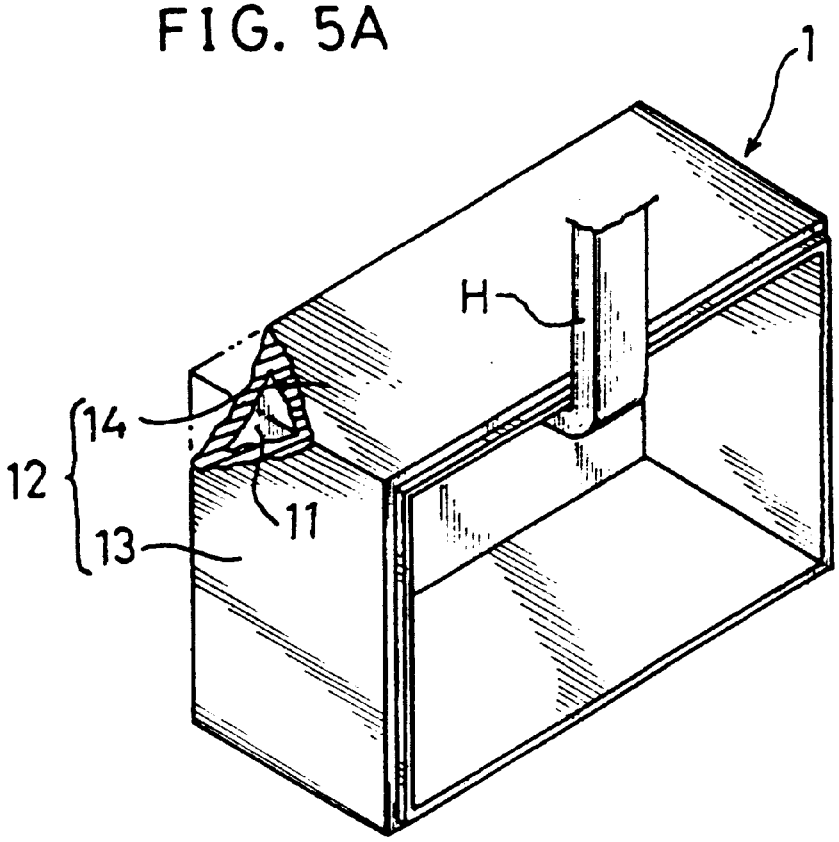
FIGS. 5A and 5B are diagrams illustrating the lower and upper structural blocks laid on their side, respectively.
Figure 5B:
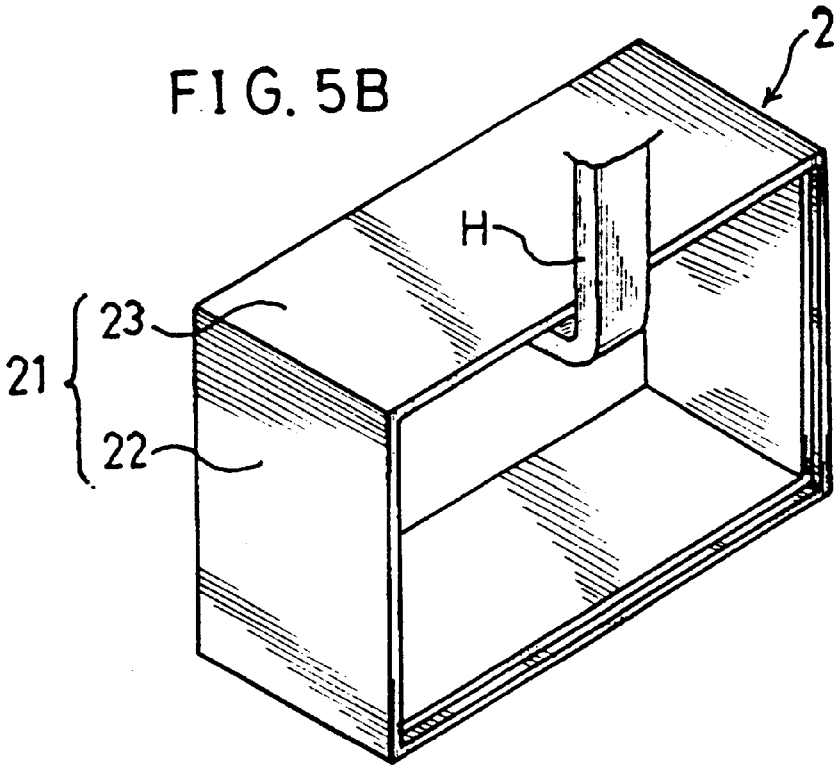

The lower and upper structural blocks 1, 2 thus produced are laid on their side as shown in FIGS. 5A and 5 B, respectively. This would considerably facilitate handling, in-factory conveying, and transportation of these structural blocks 1, 2. More specifically, the individual structural blocks 1, 2 laid on their side can be easily hoisted by an L-shaped lifting arm H in factories and conveniently loaded on a block-carrying vehicle 7 which will be described later. An unillustrated block turning machine is used when laying the structural blocks 1, 2 on their side. A pair of rotary arms of the block turning machine which are pressed tight against the short side walls 13, 22 lift each structural block 1, 2. Then, the rotary arms rotate each structural block 1, 2 by 90 degrees and lay it on its side.

Figure 6A:
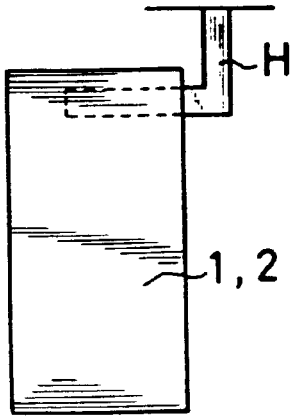
FIGS. 6A and 6B are diagrams illustrating examples of handling and conveying the individual structural blocks, FIG. 6A showing how each structural block is hoisted by a lifting arm, and FIG. 6B showing one of the structural blocks which is being moved by a conveyor C.
Figure 6B:
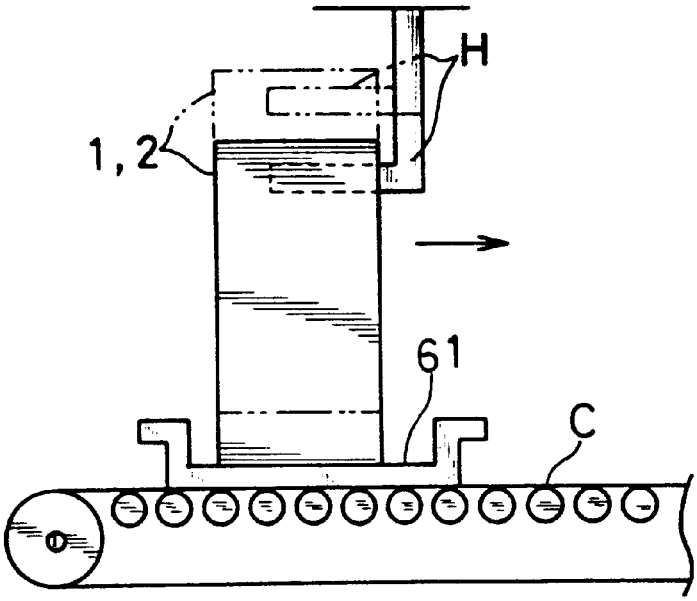

FIGS. 6A and 6 B are diagrams illustrating examples of handling and conveying the structural blocks 1, 2, FIG. 6A showing how each structural block 1, 2 is hoisted by the lifting arm H, and FIG. 6B showing one of the structural blocks 1, 2 which is being moved by a conveyor C. Each structural block 1, 2 removed from the form 41, 42 is laid on its side by the aforementioned block turning machine. Then, a horizontal part of the lifting arm H which is attached to an overhead traveling crane, for example, is inserted into the structural block 1, 2 and is hoisted and moved up to the conveyor C. The structural block 1, 2 is then placed on a rack base (supporting plate) 61 which has already been placed on the conveyor C. The conveyor C carries the structural block 1, 2 up to a loading site, where the structural block 1, 2 is loaded on the block-carrying vehicle 7 together with the rack base 61.

Figure 7:
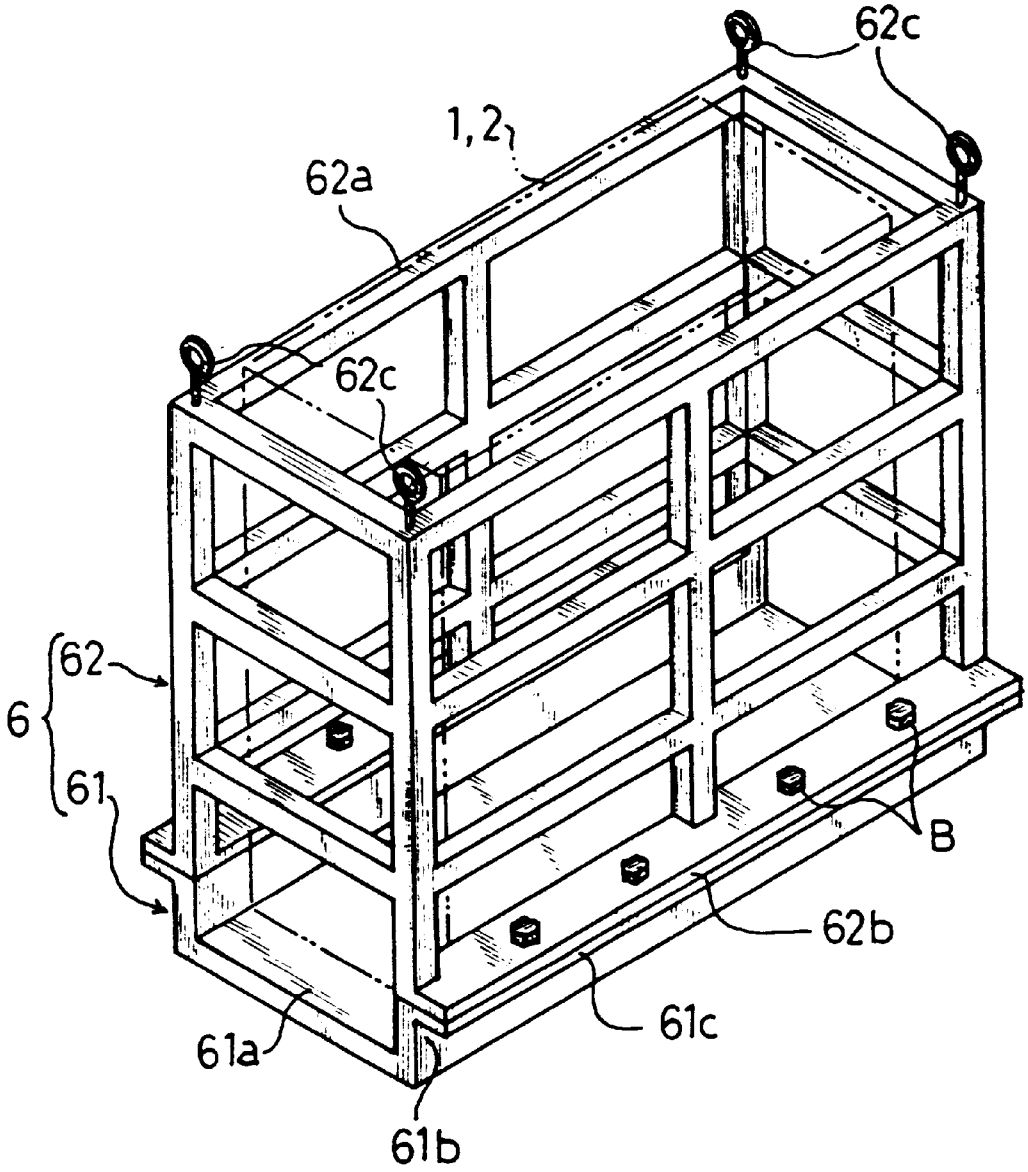
FIG. 7 is a perspective view of a block-carrying rack.

An arrangement for loading and transportation of the lower and upper structural blocks 1, 2 is now described. FIG. 7 is a perspective view of a block-carrying rack 6. To protect the structural blocks 1, 2 from damage and to prevent them from turning over during transportation, each structural block 1, 2 is housed in the rack 6. As can be seen from FIG. 7, the rack 6 comprises the aforementioned rack base 61 and a rack frame 62 which can be firmly attached to and removed from the rack base 61. The rack frame 62 is laid over the structural block 1, 2 which is already mounted on the rack base 61 and secured to the rack base 61 to protect the structural block 1, 2 during transportation.

The rack base 61 has a flat bottom plate portion 61*a*, a pair of low-profile side plate portions 61*b* extending vertically upward from both long sides of the bottom plate portion 61*a*, and flanges 61*c* extending outward from the top of the side plate portions 61*b*. The rack frame 62 comprises a framework 62*a* constructed by joining steel square bars into a boxlike shape and a pair of flanges 62*b* extending outward from both long sides of the bottom of the framework 62*a* corresponding to the flanges 61*c* of the rack base 61.

The rack frame 62 is placed on the rack base 61 with the flanges 62*b* of the former aligned with the flanges 61*c* of the latter. The rack base 61 and the rack frame 62 are joined together by securing their flanges 62*b*, 61*c* with bolts B as shown in FIG. 7. The framework 62*a* is fitted with upward-projecting hoist rings 62*c* close to the four corners of the framework topside. When removing the rack frame 62 off the rack base 61, the rack frame 62 is lifted by wire ropes passed through these hoist rings 62*c* by using a crane, for example.

Figure 8A:
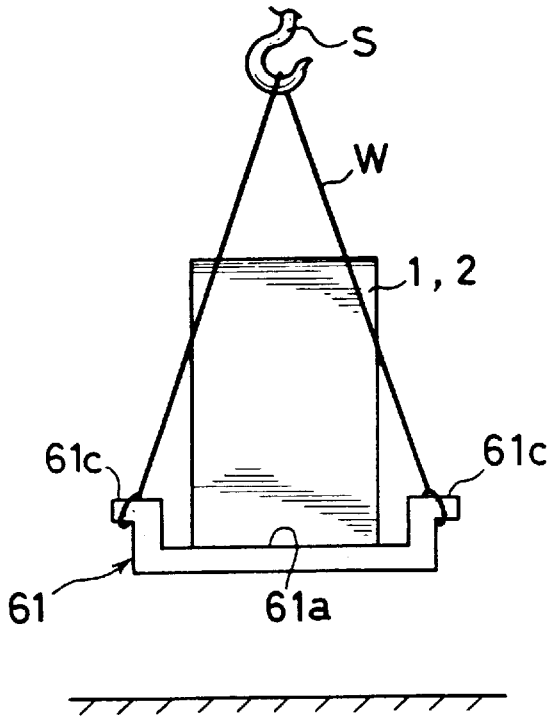
FIGS. 8A and 8B are diagrams illustrating preparatory work for loading each structural block, FIG. 8A showing how a rack base loaded with one structural block is lifted by a hook of a crane, and FIG. 8B showing a status after the rack base has been placed on a transporting pallet by the crane.
Figure 8B:
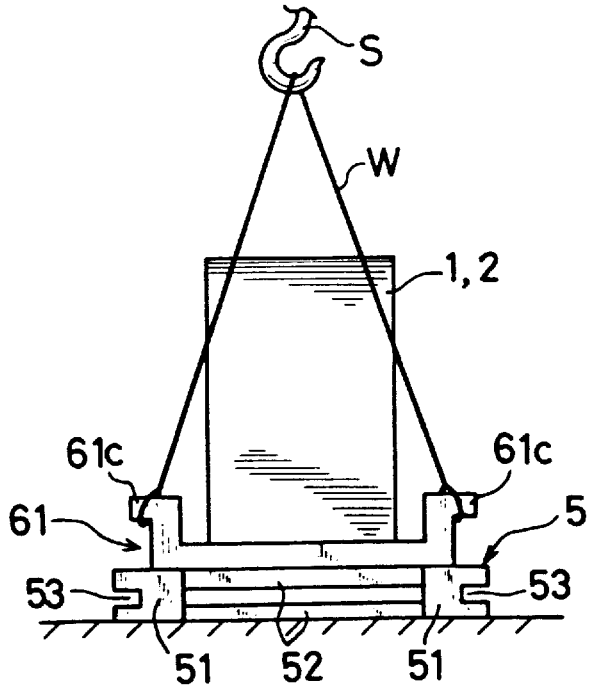
Figure 9:
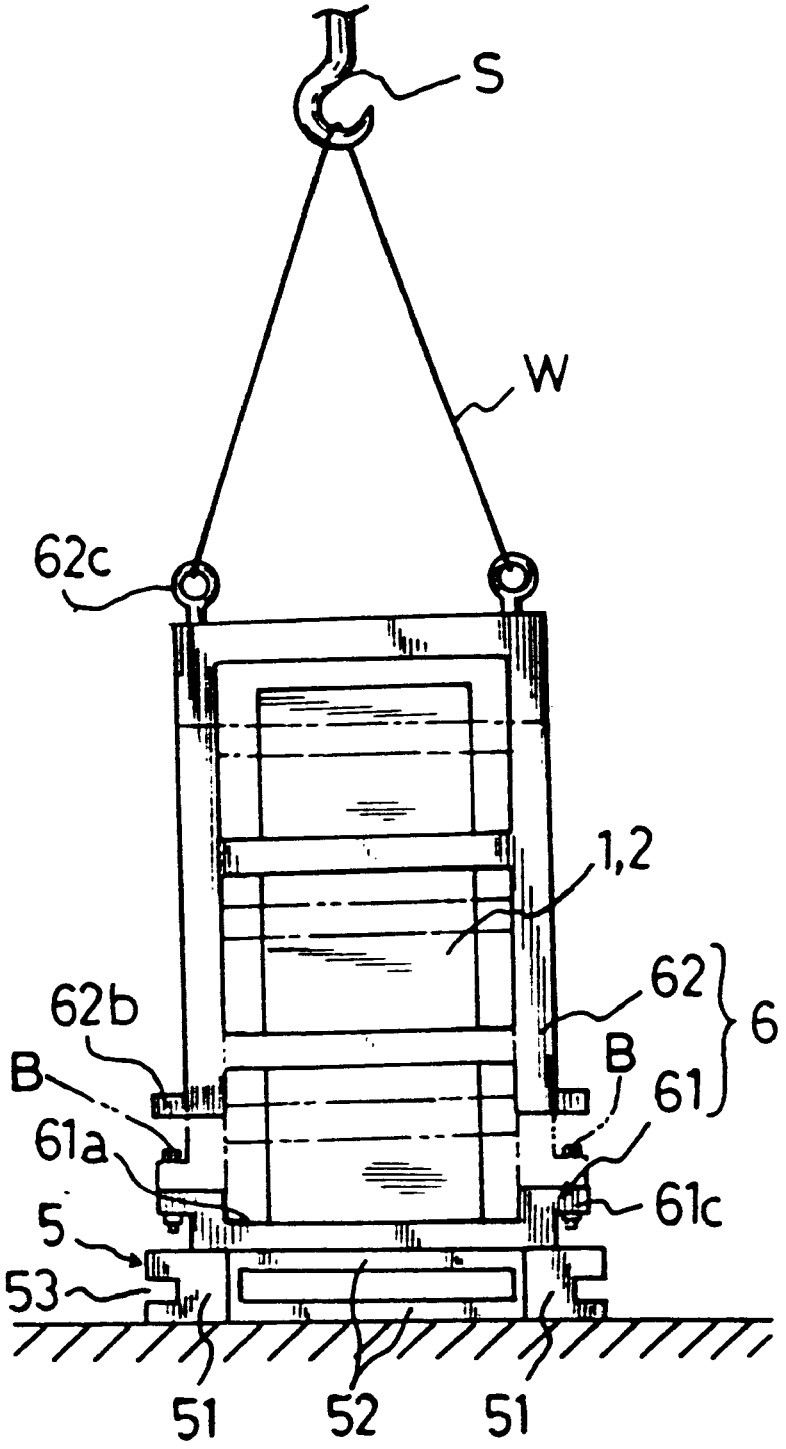
FIG. 9 is a diagram illustrating how a rack frame is mounted atop the rack base.
Figure 10A:
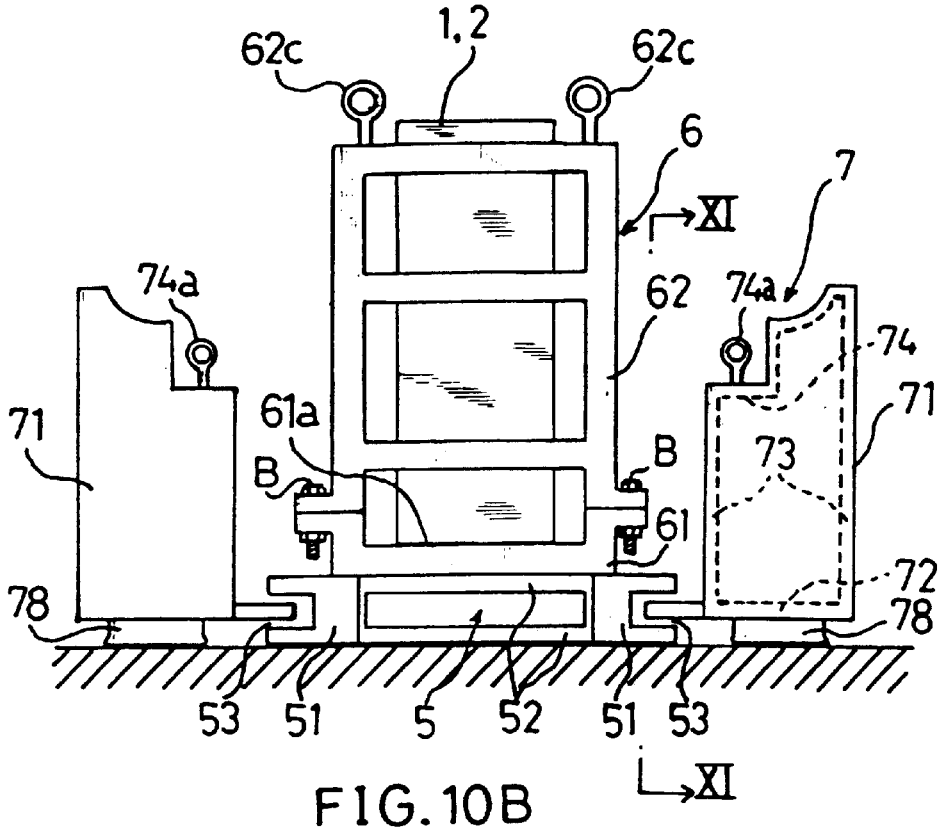
FIGS. 10A and 10B are diagrams illustrating how the structural block mounted in the rack is loaded on a load-carrying vehicle, FIG. 10A showing a status after the vehicle has approached the pallet laid on the ground, and FIG. 10B showing a status after the rack-mounted structural block has been loaded on board the vehicle together the pallet.
Figure 10B:
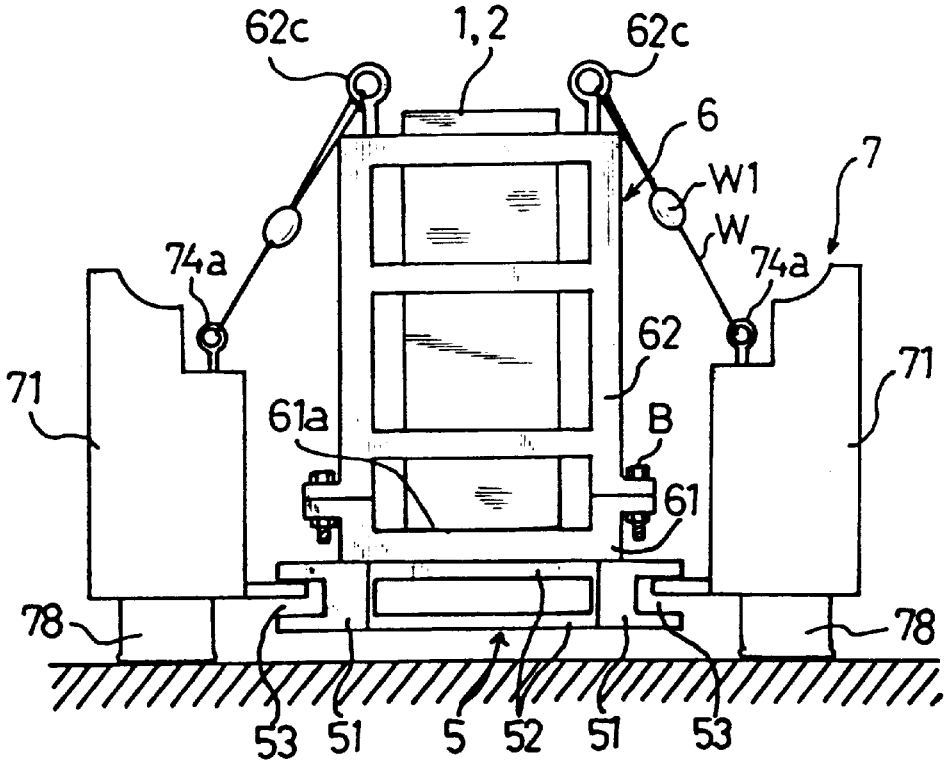
Figure 11:
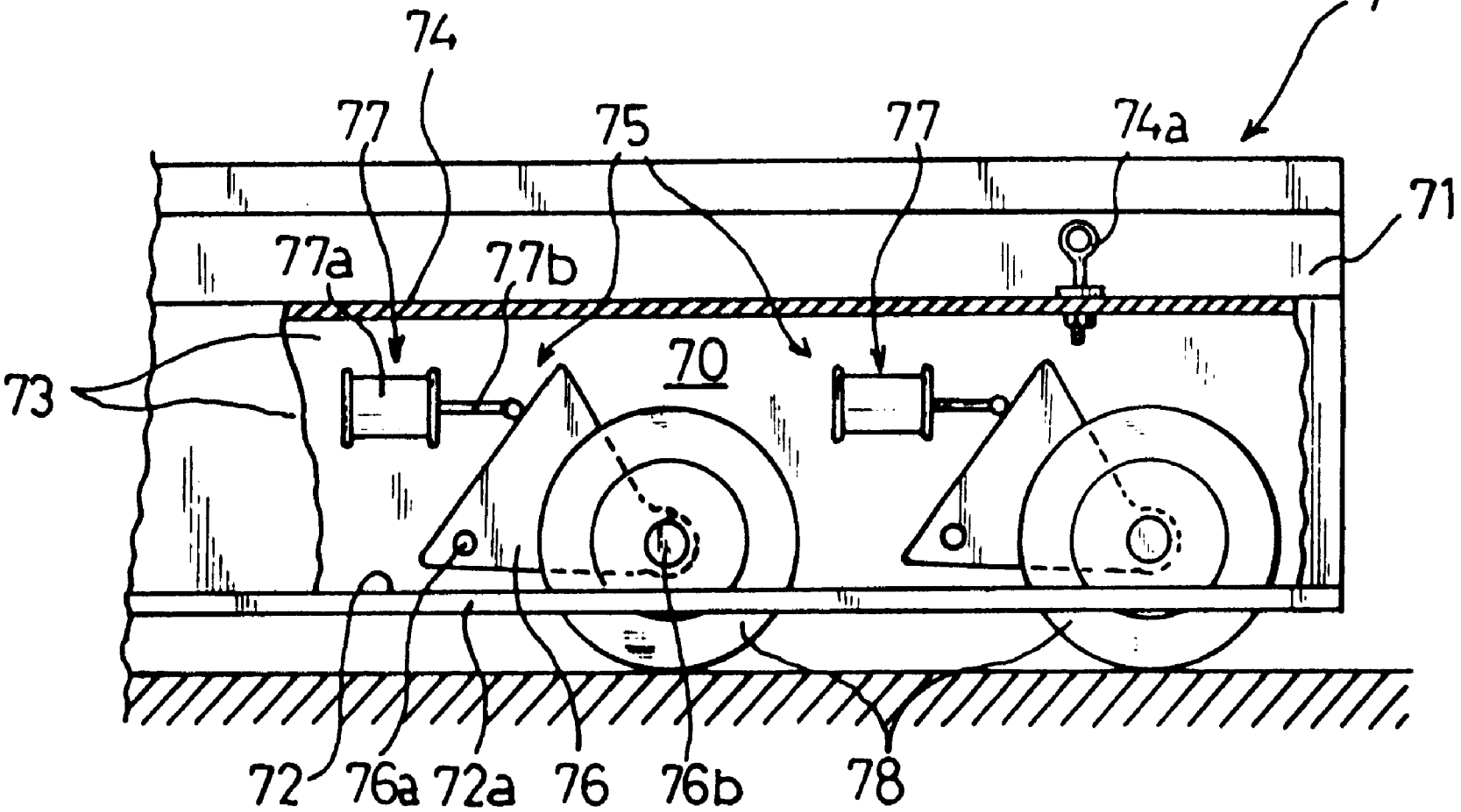
FIG. 11 is a partially sectional view taken along lines A—A of FIG. 10A for depicting functional features of the vehicle 7.

FIGS. 8A and 8 B are diagrams illustrating preparatory work for loading each structural block 1, 2, FIG. 8A showing how the rack base 61 loaded with one structural block 1, 2 is lifted by a hook S of a crane, and FIG. 8B showing a status after the rack base 61 has been placed on a transporting pallet 5 by the crane. FIG. 9 is a diagram illustrating how the rack frame 62 is mounted atop the rack base 61. FIGS. 10A and 10B are diagrams illustrating how the structural block 1, 2 mounted in the rack 6 is loaded on the block-carrying vehicle 7, FIG. 10A showing a status after the vehicle 7 has been pulled up to the pallet 5 laid on the ground, and FIG. 10B showing a status after the rack-mounted structural block 1, 2 has been loaded on board the vehicle 7 together the pallet 5. FIG. 11 is a partially sectional view taken along lines XI—XI of FIG. 10A for depicting functional features of the vehicle 7.

Referring to FIGS. 6B and 8 through 11, a procedure for loading each structural block 1, 2 on the block-carrying vehicle 7 is described below. When the structural block 1, 2 mounted on the rack base 61 has been brought up to the loading site by the conveyor C shown in FIG. 6B, four wires W (only two wires W are shown in FIGS. 8A and 8 B) are attached to four corners of the flanges 61*c* of the rack base 61. These four wires W are bundled together at their upper ends and hooked by the hook S of the crane which is not illustrated, and the rack base 61 loaded with the structural block 1, 2 is hoisted. The rack base 61 is then placed on the pallet 5 which is laid on the ground in such a way that no part of the rack base 61 extends sideways out of the pallet 5.

The aforementioned transporting pallet 5 is an intermediate supporting device which would be located between the rack 6 and the block-carrying vehicle 7 when loaded on the vehicle 7 as shown in FIG. 10B. The pallet 5 comprises a pair of side rails 51 which extend along the longitudinal axis of the vehicle 7 (or at right angles to the page showing FIG. 8B) when loaded onboard and upper and lower deckboards 52 individually bridged between the side rails 51. A U-shaped groove 53 is formed in the outer side surface of each side rail 51 along its longitudinal axis. The grooves 53 in the side rails 51 are used when the pallet 5 carrying the rack-mounted structural block 1, 2 is loaded on the vehicle 7 at a later time.

When the rack base 61 loaded with the structural block 1, 2 has been placed on the pallet 5 as shown in FIG. 8B, the wires W are detached from the rack base 61. The rack frame 62 hung by the crane hook S and wires W is placed on the rack base 61 so that the rack frame 62 surrounds the structural block 1, 2, and then the upper and lower flanges 62*b*, 61*c* which have been brought into contact and aligned with each other are joined by the bolts B. At this point, the structural block 1, 2 is fully set in the rack 6. The wires W are removed from the rack frame 62 to complete preparatory operation for loading the structural block 1, 2 on the vehicle 7.

Next, the rack-mounted structural block 1, 2 mounted on the pallet 5 is loaded on the vehicle 7 as shown in FIGS. 10A and 10B. The vehicle 7 is an ultralow-deck semitrailer having separate right and left axles and separate right and left load-carrying decks 71 as illustrated. This vehicle 7 has the capability to raise and lower the loaded pallet 5 so that the clearance between the bottom of the pallet 5 and the road surface can be varied between 4 cm and 30 cm.

As shown in FIG. 11, each of the load-carrying decks 71 comprises a bottom board 72 extending parallel to the longitudinal axis of the vehicle 7, a pair of side boards 73 extending vertically upward (or at right angles to the page showing FIG. 11) from both sides of the bottom board 72, a top board 74 spanning between the upper ends of the pair of side boards 73, an elevating mechanism 75 installed in a machine space 70 enclosed by the bottom board 72, the side boards 73 and the top board 74. Further, a pair of pallet supporting plates 72*a* horizontally jut out from the inner ends of the bottom boards 72 of both the right and left load-carrying decks 71. The distance between the right and left pallet supporting plates 72*a* is made a little larger than the distance between the bottoms of the U-shaped grooves 53 so that the pallet supporting plates 72*a* can slip into the right and left U-shaped grooves 53.

The elevating mechanism 75 installed in the machine space 70 of each load-carrying deck 71 comprises a plurality of cams 76 having a triangular shape in side view and arranged in a row along the longitudinal axis of the vehicle 7, a plurality of cylinder actuators 77 associated with the individual cams 76 for driving them, and wheels 78 fitted with tires that are connected to the cams 76. Each of the triangular-shaped cams 76 is so arranged that its base (bottom side) becomes approximately parallel to the road surface and is swingably mounted on a supporting shaft 76*a* spanning between the side boards 73 at a left corner portion of each cam 76 (as illustrated in FIG. 11). The wheels 78 are rotatably mounted on axles 76*b* which are individually connected to right corner portions of the cams 76.

Each of the cylinder actuators 77 comprises an air cylinder 77*a* fixed in parallel to the longitudinal axis and a piston rod 77*b* projecting from the air cylinder 77*a* toward the cam 76. The extreme end of each piston rod 77*b* is held in contact with a slant edge of the corresponding cam 76 above its supporting shaft 76*a* so that rotational motion of the cam 76 about the supporting shaft 76*a* is restricted. The piston rods 77*b* extend out from the respective air cylinders 77*a* when the cylinder actuators 77 are operated. As a result, the individual cams 76 swing in a clockwise direction (as illustrated in FIG. 11) about the respective supporting shafts 76*a*, causing the individual load-carrying decks 71 to ascend. When the cylinder actuators 77 are reversely operated, the piston rods 77*b* retract into the respective air cylinders 77*a*, and the load-carrying decks 71 are caused to descend. The right and left pallet supporting plates 72*a* of the vehicle 7 can be raised and lowered by operating the cylinder actuators 77 in their forward and reverse directions as described above, and the pallet 5 carrying the rack-mounted structural block 1, 2 can be loaded onto and unloaded from the vehicle 7 with this deck raising and lowering operation.

A detailed method of loading the rack-mounted structural block 1, 2 placed on the pallet 5 is discussed below with reference to FIGS. 10A and 10B. First, the height of the respective load-carrying decks 71 is adjusted by operating the cylinder actuators 77 in such a way that both the right and left pallet supporting plates 72*a* are aligned at the same height with the U-shaped grooves 53 of the pallet 5. The vehicle 7 is then moved backward so that the pallet 5 is located just between the right and left load-carrying decks 71. When the vehicle 7 is stopped in its correct position, the right and left pallet supporting plates 72*a* are properly located in the respective U-shaped grooves 53 of the pallet 5 as shown in FIG. 10A.

Subsequently, the cylinder actuators 77 are operated to cause the piston rods 77*b* to extend. As a consequence, the individual cams 76 turn in the clockwise direction (as illustrated in FIG. 11) about the respective supporting shafts 76*a*. This causes the right and left load-carrying decks 71 to ascend, and the pallet 5 supported by the pallet supporting plates 72*a* is lifted above the ground to a ready-to-dispatch position. Wires W are stretched between the hoist rings 62*c* at the top of the rack 6 and binding rings 74*a* projecting from the individual load-carrying decks 71 to prevent the rack 6 from turning over during transportation. The wires W are fitted with puller hoists W1 to adjust the tension of each wire W and thereby secure the rack 6 in correct position. The structural block 1, 2 protected by the rack 6 is transported by the vehicle 7 to a construction site in this condition.

Figure 12:
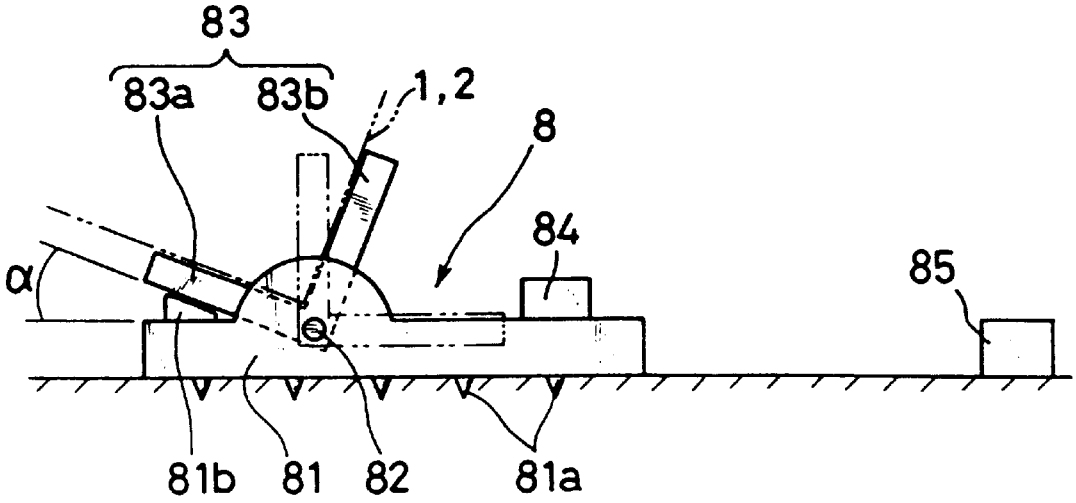
FIG. 12 is a side view of a load-receiving jig which is mounted on the ground when unloading the structural block from the vehicle.

A process of unloading the structural block 1, 2 which has arrived at the construction site is now described. FIG. 12 is a side view of a load-receiving jig 8 which is mounted on the ground when unloading the structural block 1, 2 from the vehicle 7. As shown in the Figure, the load-receiving jig 8 comprises a jig base 81 formed of a generally rectangular-shaped frame, a horizontal shaft 82 spanning between opposite framing members of the jig base 81, a load-receiving part 83 pivotably mounted on the horizontal shaft 82, and a dunnage (load-protecting member) 84 which is located between the framing members outside the pivoting area of the load-receiving part 83. The jig base 81 is provided with a plurality of spikes 81*a* on its bottom. When the load-receiving jig 8 is placed on the ground, the spikes 81*a* securely bite into the ground to ensure stable positioning of the load-receiving jig 8.

The load-receiving part 83 is constructed into an L-shaped form in side view, including a first member 83*a* and a second member 83*b* which are joined at right angles with each other into a one-piece structure. When unloading the rack-mounted structural block 1, 2 by using a crane, one bottom edge of the rack 6 is aligned with an intersection between the first and second members 83*a*, 83*b* of the load-receiving part 83, and the load-receiving part 83 pivots about the horizontal shaft 82 as the rack 6 is turned clockwise (as illustrated in FIG. 12). This pivoting action of the load-receiving part 83 prevents or alleviates shocks to the structural block 1, 2 during unloading operation.

The jig base 81 is fitted with a stopper 81*b* just beneath the first member 83*a*. The stopper 81*b* is so arranged that the first member 83*a* and the horizontal form a specified angle □ when the first member 83*a* comes into contact with the stopper 81*b*. Thus, the load-receiving part 83 is not allowed to pivot in the counterclockwise direction (as illustrated in FIG. 12) beyond that angle. In the present embodiment, the height and location of the stopper 81*b* are set such that the angle between the first member 83*a* and the horizontal becomes approximately 30 degrees when the load-receiving part 83 has reached the counterclockwise limit of its pivoting motion. The load-receiving part 83 is also made pivotable around the horizontal shaft 82 up to about 90 degrees in the clockwise direction from the position where the first member 83*a* is in contact with the stopper 81*b*.

The dunnage 84 is biased upward by an elastic member like a coil spring so that it normally projects above the jig base 81 by a specified amount. When the rack 6 is laid on the dunnage 84, it retracts into the jig base 81 against a pushing force exerted by the elastic member. When the rack 6 containing the structural block 1, 2 placed on the load-receiving part 83 is turned about the horizontal shaft 82 until the rack 6 comes into contact with the dunnage 84, the dunnage 84 retracting into the jig base 81 buffers shocks which may potentially be caused to the structural block 1, 2 when the rack 6 is laid on its side.

Square timber 85 is placed to the right of the load-receiving jig 8 as illustrated in FIG. 12. This square timber 85 placed on the ground has the same height as the jig base 81 above the ground level so that the rack 6 laid on its side by using the load-receiving jig 8 is set in a correct horizontal position.

Figure 13A:
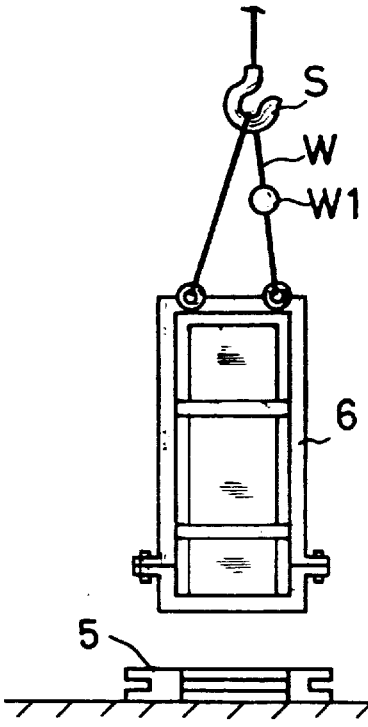
FIGS. 13A to 13C are diagrams illustrating a process of unloading the rack containing the structural block, FIG. 13A showing a status in which the rack containing the structural block is lifted by a hook of a crane, FIG. 13B showing a status in which the rack lifted by the hook of the crane is tilted, and FIG. 13C showing a status in which the rack lifted by the hook of the crane has been placed on the load-receiving jig.
Figure 13B:
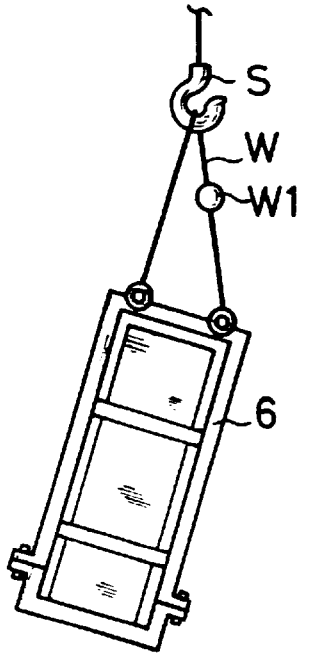
Figure 13C:
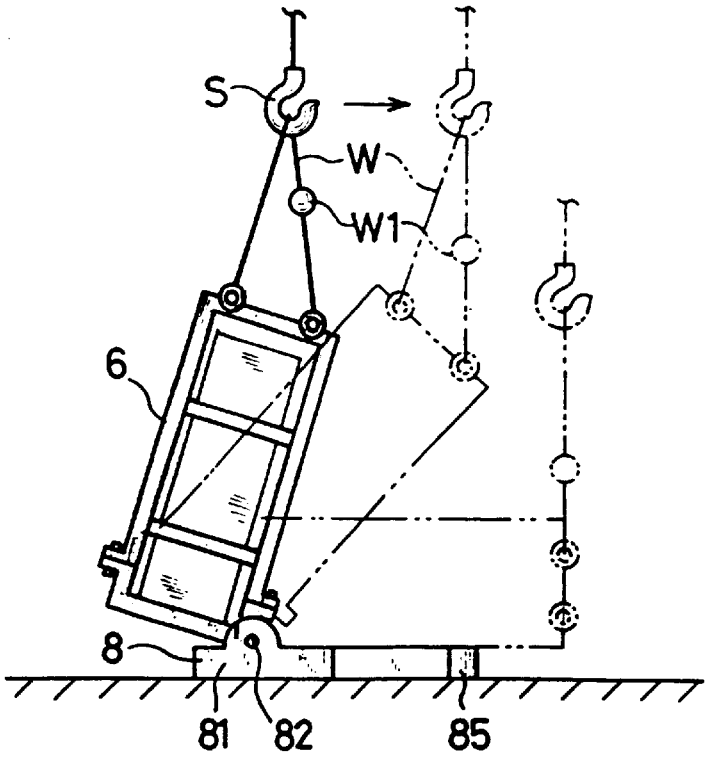

FIGS. 13A to 13 C are diagrams illustrating the process of unloading the rack 6 containing the structural block 1, 2, FIG. 13A showing a status in which the rack 6 containing the structural block 1, 2 is lifted by a hook S of a crane which is not illustrated, FIG. 13B showing a status in which the rack 6 lifted by the hook S of the crane is tilted, and FIG. 13C showing a status in which the rack 6 lifted by the hook S of the crane has been placed on the load-receiving jig 8.

When the vehicle 7 carrying the rack-mounted structural block 1, 2 has arrived at the construction site, the rack 6 containing the structural block 1, 2 is laid on the ground following the steps shown in FIG. 10 in the reverse order (FIG. 10B to FIG. 10A). Two wires W, each connected to two hoist rings 62*c* on each opposite end of the rack 6, are hooked up on the hook S of the crane and the rack 6 is lifted as shown in FIG. 13A. The rack 6 containing the structural block 1, 2 is then tilted by operating a puller hoist W1 attached to each wire W as shown in FIG. 13B, moved up to a position where the lowest bottom edge of the rack 6 is located above load-receiving part 83 of the load-receiving jig 8 and lowered onto the load-receiving part 83 so that the lowest bottom edge of the rack 6 slides down toward the intersection between the first and second members 83*a*, 83*b* of the load-receiving part 83 as shown in FIG. 13C.

The hook S is lowered by operating the crane, and as a consequence, the rack 6 containing the structural block 1, 2 supported by the load-receiving part 83 is further tilted around the horizontal shaft 82 and eventually rests on the load-receiving jig 8 and the square timber 85 in a horizontal position as shown by alternate long and two short dashed lines in FIG. 13C. The rack 6 is removed from the structural block 1, 2 in this horizontal position by using specific tools and machinery which are not illustrated. The structural block 1, 2 is then placed in an already excavated pit.

A detailed procedure of on-site basement construction is now described. A vertical pit which can accommodate at least the lower structural block 1 should be excavated in the construction site before installing the basement unit 10. A stone foundation is created by depositing crushed stone on the bottom of the pit. Then, the lower structural block 1 lifted with its bottom down is laid in place on the stone foundation. The earlier-mentioned seal member 3 is placed on the surrounding walls 12 of the lower structural block 1 and the upper structural block 2 is stacked on the lower structural block 1 to complete the basement unit 10 in the pit.

Lining may be made along the seal member 3 placed between the lower structural block 1 and the upper structural block 2 from inside the basement unit 10 to provide enhanced waterproofing and thereby prevent water intrusion in a more reliable manner.

Further, a specific number of friction piles may be driven into the bottom of the pit before placing the lower structural block 1 in position. This will allow an upper part of the basement unit 10 to be used as a foundation which can securely support a structure to be built above the ground.

Figure 14:
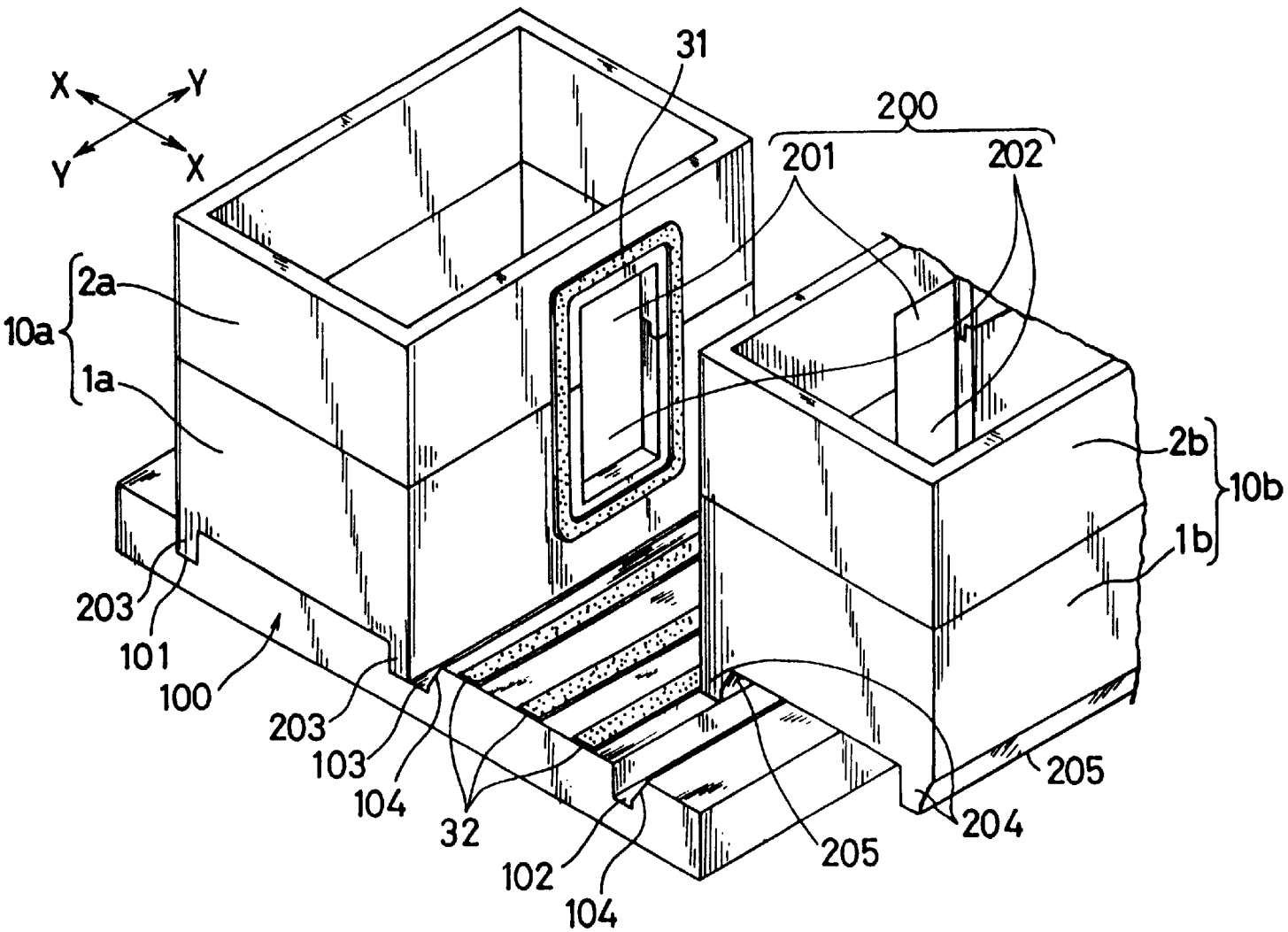
FIG. 14 is an exploded perspective view illustrating a two-room basement structure according to a second embodiment of the invention, in which a second basement unit is being installed next to a first basement unit.
Figure 15:
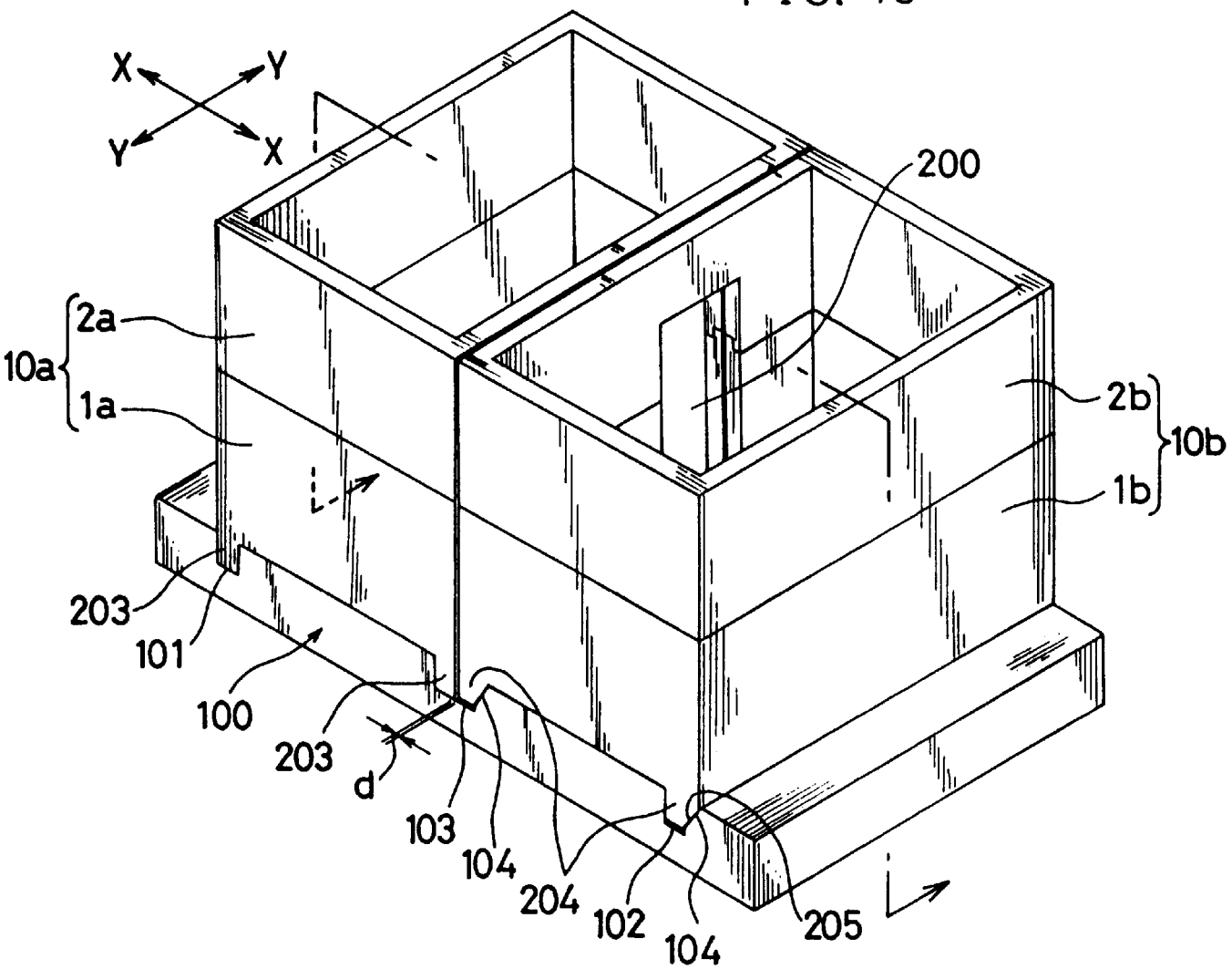
FIG. 15 is a perspective view illustrating the two-room basement structure, in which the second basement unit has been installed next to the first basement unit.
Figure 16:
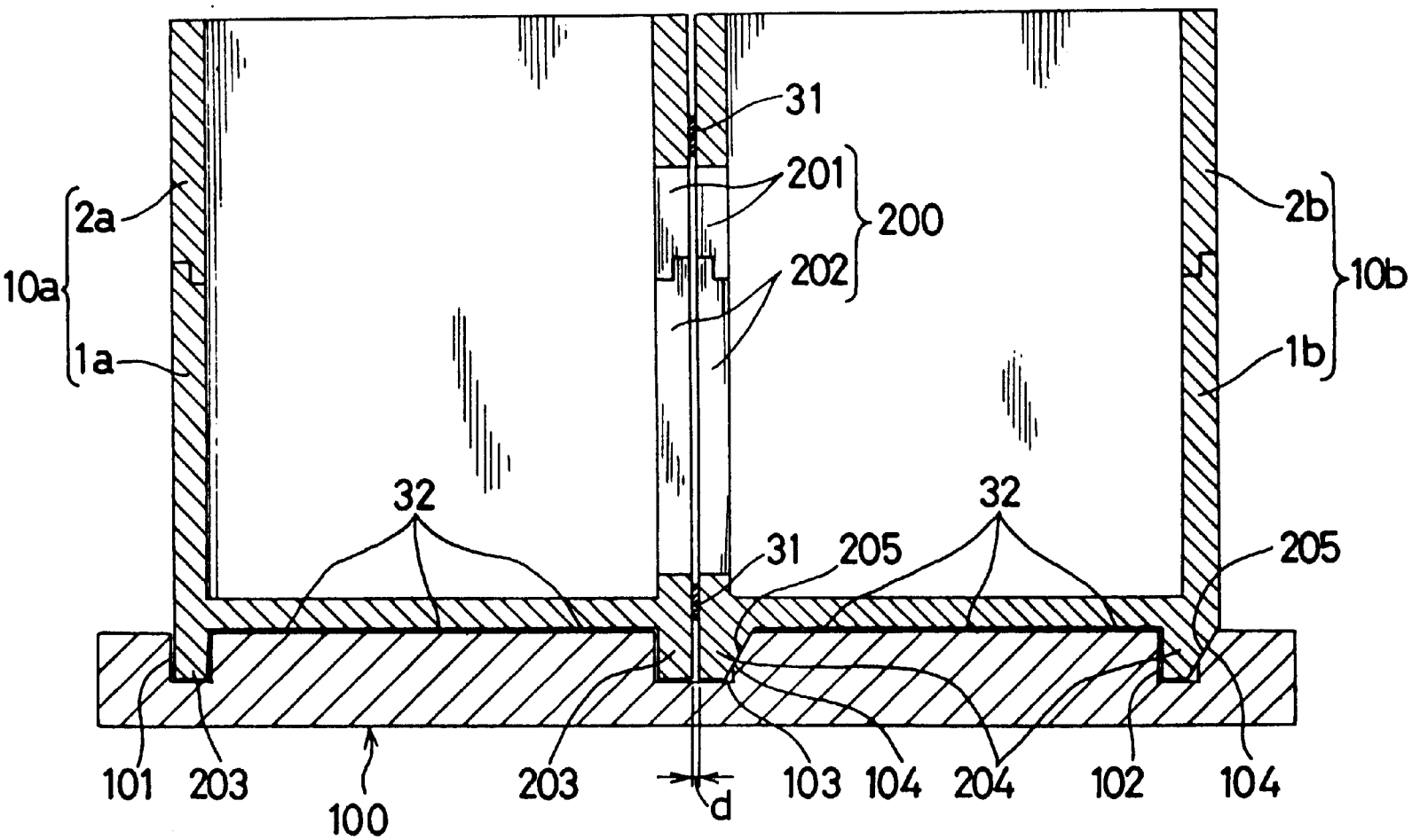
FIG. 16 is a vertical sectional view taken along lines B—B of FIG. 15.

FIG. 14 is an exploded perspective view illustrating a two-room basement structure according to a second embodiment of the invention, in which a second basement unit 10*b* is being installed next to a first basement unit 10*a*. FIG. 15 is a perspective view illustrating the two-room basement structure, in which the second basement unit 10*b* has been installed next to the first basement unit 10*a*. FIG. 16 is a vertical sectional view taken along lines B—B of FIG. 15. As a convention in the explanation to follow in this Specification, the direction parallel to the X axis shown in FIGS. 14 and 15 is referred to as the longitudinal direction and the direction parallel to the Y axis is referred to as the transverse direction. As shown in these Figures, the adjacent first basement unit 10*a* and the second basement unit 10*b* are mounted on a single foundation panel 100 having a specified thickness and a rectangular shape in plan view.

The first basement unit 10*a* comprises a first lower structural block 1*a* and a first upper structural block 2*a* stacked on top of the first lower structural block 1*a*. Similarly, the second basement unit 10*b* comprises a second lower structural block 1*b* and a second upper structural block 2*b* stacked on top of the second lower structural block 1*b*. The two-room basement structure is constructed by installing the first basement unit 10*a* and the second basement unit 10*b* side by side on the foundation panel 100.

Although the first upper structural block 2*a* and the second upper structural block 2*b* have basically the same construction as the upper structural block 2 of the first embodiment, the first upper structural block 2*a* and the second upper structural block 2*b* each have a rectangular lower cutout 201 in the bottom ends of their facing walls which extend parallel to the transverse direction. Likewise, the first lower structural block 1*a* and the second lower structural block 1*b* each have an upper cutout 202 in the top ends of their facing walls at a position corresponding to each lower cutout 201. When the first and second upper structural block 2*a*, 2*b* are stacked on the first and second lower structural block 1*a*, 1*b*, respectively, or when the first basement unit 10*a* and the second basement unit 10*b* have been completed, a rectangular door opening 200 is formed of the lower cutout 201 and the upper cutout 202 in their facing walls.

The first lower structural block 1*a* has on its bottom a pair of first bottom projections 203 horizontally extending in the transverse direction as illustrated in FIGS. 14 an 15, one of the first bottom projections 203 projecting downward from the wall having the upper cutout 202 by a specified amount and the other projecting downward from the opposite wall by the same amount. These first bottom projections 203 have a rectangular cross section as viewed along the transverse direction. The second lower structural block 1*b* also has on its bottom a pair of second bottom projections 204 horizontally extending in the transverse direction, one of the second bottom projections 204 projecting downward from the wall having the upper cutout 202 by a specified amount and the other projecting downward from the opposite wall by the same amount. These second bottom projections 204 have an inverted trapezoidal cross section with slant surfaces 205 formed on their right side as viewed along the transverse direction.

The foundation panel 100 is a generally flat reinforced concrete plate having a specified thickness. The foundation panel 100 is made a little larger than the combination of the first basement unit 10*a* and the second basement unit 10*b* in horizontal dimensions. A first retaining groove 101, a second retaining groove 102 and a central retaining groove 103, each extending in the transverse direction, are formed in the top surface of the foundation panel 100. These grooves 101–103 are located as stated below to retain the aforementioned first and second bottom projections 203, 204 of the lower structural block 1*a*, 1*b*. The first retaining groove 101 is formed parallel to the left end of the foundation panel 100 to allow the left-hand first bottom projection 203 of the first lower structural block 1*a* to slide into position; the second retaining groove 102 is formed parallel to the right end of the foundation panel 100 to allow the right-hand second bottom projection 204 of the second lower structural block 1*b* to slide into position; and the central retaining groove 103 runs across the middle part of the foundation panel 100 so that both the right-hand first bottom projection 203 of the first lower structural block 1*a* and the left-hand second bottom projection 204 of the second lower structural block 1*b* can slide into position.

The depth and width of the first retaining groove 101 are made slightly larger than the vertical extension and width of the left-hand first bottom projection 203, respectively, while the second retaining groove 102 is made slightly larger than the trapezoidal second bottom projection 204 of the second lower structural block 1*b* in cross section. It is to be noted that one of the side walls of the second retaining groove 102 forms a slant surface 104 so that the slant surface 205 of the right-hand second bottom projection 204 slides along the slant surface 104 of the second retaining groove 102 to allow the right-hand second bottom projection 204 to be set in its correct position in the second retaining groove 102.

The dimensions of the central retaining groove 103 are such that the right-hand first bottom projection 203 and the left-hand second bottom projection 204 can fit together in the central retaining groove 103. The right-hand side wall of the central retaining groove 103 also forms a slant surface 104.

With the above-described configuration, the first lower structural block 1*a* stacked with the first upper structural block 2*a* is first placed on the foundation panel 100 with the individual first bottom projections 203 fitted in the first retaining groove 101 and the central retaining groove 103. Then, the second lower structural block 1*b* stacked with the second upper structural block 2*b* is placed on the foundation panel 100 with the individual second bottom projections 204 fitted in the central retaining groove 103 and the second retaining groove 102. Consequently, the second lower structural block 1*b* is set in its correct position on the foundation panel 100, adjacent to the first lower structural block 1*a*.

A generally rectangular seal member 31 formed of an elastic material such as rubber is attached around the door opening 200 of the first basement unit 10*a* on its external wall surface by use of an adhesive. As the second basement unit 10*b* is mounted on the foundation panel 100 next to the first basement unit 10*a*, the second basement unit 10*b* presses against the rectangular seal member 31, whereby intrusion of groundwater and rainwater into the internal space of each basement unit 10*a*, 10*b* is prevented. A plurality of thin rubber strips 32 are attached on the top surface of the foundation panel 100 parallel to its transverse direction. These rubber strips 32 not only serve as a cushion, but their frictional resistance effectively prevents the first and second basement units 1*a*, 10*b* from shifting from their correct positions on the foundation panel 100 especially in its longitudinal direction.

The depth and width of the central retaining groove 103 are so determined that a specified clearance d is created between the facing wall surfaces of the first and second basement units 10*a*, 10*b* when the second basement unit 10*b* has been placed adjacent to the first basement unit 10*a* and securely set in its position on the foundation panel 100 as shown in FIGS. 15 and 16. This clearance d is made slightly larger than the minimum compressed thickness of the rectangular seal member 31. This ensures that the rectangular seal member 31 is not destroyed when compressed between the facing walls of the first and second basement units 10*a*, 10*b* and that the rectangular seal member 31 tightly adheres to the wall surfaces with its effective elastic property, providing a good waterproofing effect.

In one alternative, the width of the central retaining groove 103 may be set so that the aforementioned clearance d becomes approximately zero. In this alternative, the rectangular seal member 31 should be formed of an elastic material whose compressive strength is such that the rectangular seal member 31 would break down when compressed between the facing walls of the first and second basement units 10*a*, 10*b*. In another alternative, the rectangular seal member 31 may be formed of a plastic material like clay, for instance, which exhibits plastic deformation. If such a plastic material is employed, the rectangular seal member 31 would spread forming a thin layer between the facing walls of the first and second basement units 10*a*, 10*b* when they are mounted on the foundation panel 100. The material would set in and around microscopic pits and protrusions on the facing walls of the first and second basement units 10*a*, 10*b* and provide a satisfactory waterproofing effect.

Figure 17A:
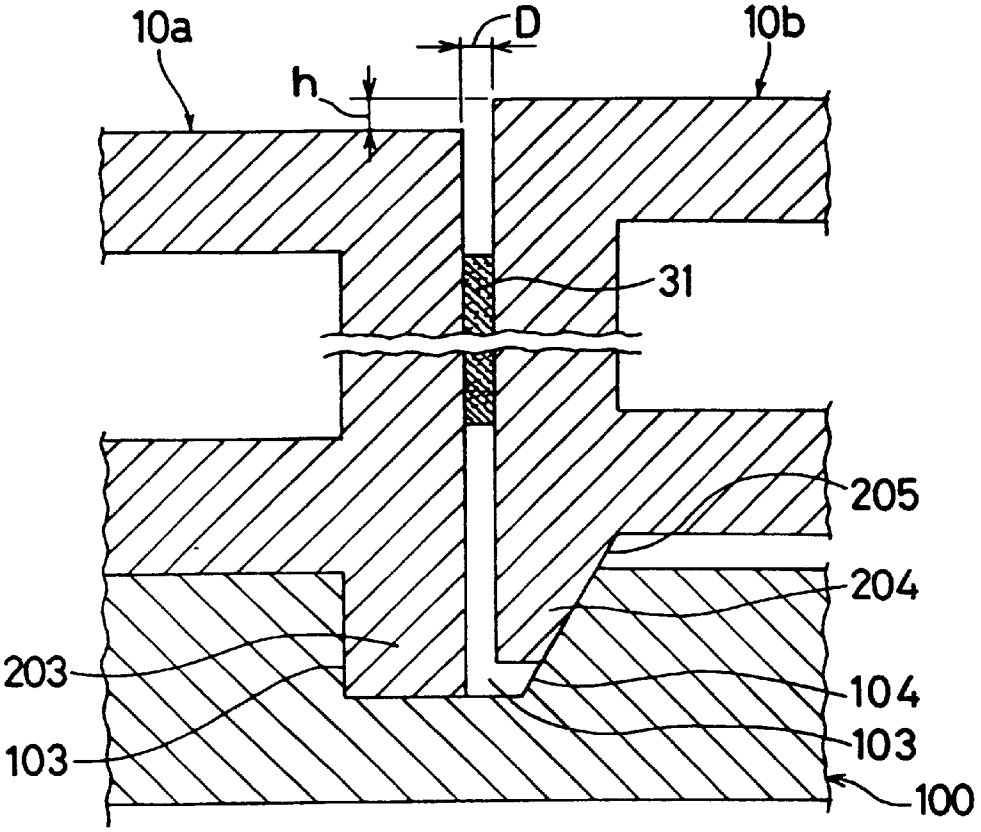
FIGS. 17A and 17B are sectional views illustrating functional features of the basement structure of the second embodiment, FIG. 17A showing a status immediately after the wall of the second basement unit facing the first basement unit has come into contact with a rectangular seal member when a second bottom projection has just been placed in a central retaining groove, and FIG. 17B showing a status after the second bottom projection has descended all the way along a slant surface of the central retaining groove, where the second basement unit is supported by a foundation panel.
Figure 17B:
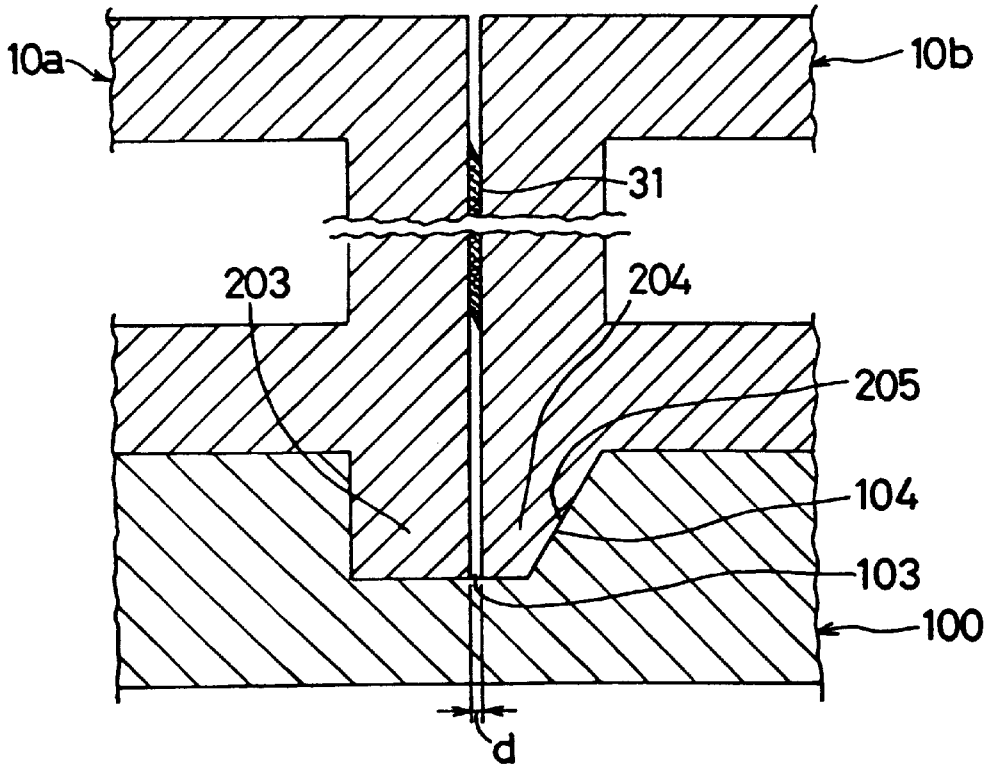

FIGS. 17A and 17 B are sectional views illustrating functional features of the basement structure of the second embodiment, FIG. 17A showing a status immediately after the wall of the second basement unit 10*b* facing the first basement unit 10*a* has come into contact with the rectangular seal member 31 when one of the second bottom projections 204 has just been placed in the central retaining groove 103, and FIG. 17B showing a status after the second bottom projection 204 has descended all the way along the slant surface 104 of the central retaining groove 103, where the second basement unit 10*b* is supported by the foundation panel 100.

According to the second embodiment, the first basement unit 10*a* hoisted by a crane is placed on the foundation panel 100 in such a way that one of the first bottom projections 203 fits into the central retaining groove 103, and then the second basement unit 10*b* is lowered by using the crane so that one of the second bottom projections 204 would go into an unoccupied portion of the central retaining groove 103. When the bottom end of the second bottom projection 204 goes down below the opening of the central retaining groove 103 and the slant surface 205 of the second bottom projection 204 comes in contact with the slant surface 104 of the central retaining groove 103, the second basement unit 10*b* is guided obliquely downward along the slant surface 104 of the central retaining groove 103. When the left-hand side wall of the second basement unit 10*b* comes in contact with the rectangular seal member 31 as illustrated in FIG. 17A, the second basement unit 10*b* is positioned a little higher than the first basement unit 10*a* as much as h. As the second basement unit 10*b* is further lowered at a controlled slow rate, it slides along the slant surface 104 and the left-hand side wall of the second basement unit 10*b* presses against the rectangular seal member 31. At this point, the rectangular seal member 31 elastically deforms and pushes against the facing walls of the first and second basement units 10*a*, 10*b*.

In this embodiment, the inclination of each slant surface 104 is set to 30 degrees and the weight of the second basement unit 10*b* is 3 to 5 tons per 1 m width in the transverse direction. This produces a pushing force F of 1.7 to 2.9 tons per 1 m width in the transverse direction, which is sufficient to cause elastic deformation of the rectangular seal member 31. When the second basement unit 10*b* is set in its lowest position and supported by the foundation panel 100 as shown in FIG. 17B, the earlier-mentioned clearance d is created between the first and second basement units 10*a*, 10*b*. The rectangular seal member 31 is compressed to a thickness slightly larger than its minimum compressed thickness at this point.

Both sides of the rectangular seal member 31 are tightly pressed against the facing wall surfaces of the first and second basement units 10*a*, 10*b* due to an elastic force caused by the compression of the rectangular seal member 31, and as a consequence, intrusion of groundwater and rainwater into the internal space of each basement unit 10*a*, 10*b* is prevented in a reliable manner. When the second bottom projection 204 of the second basement unit 10*b* has fully fitted in the central retaining groove 103 as shown in FIG. 17B, the height difference h between the first and second basement units 10*a*, 10*b* becomes zero, whereby their top surfaces are aligned in the same horizontal plane.

Figure 18:
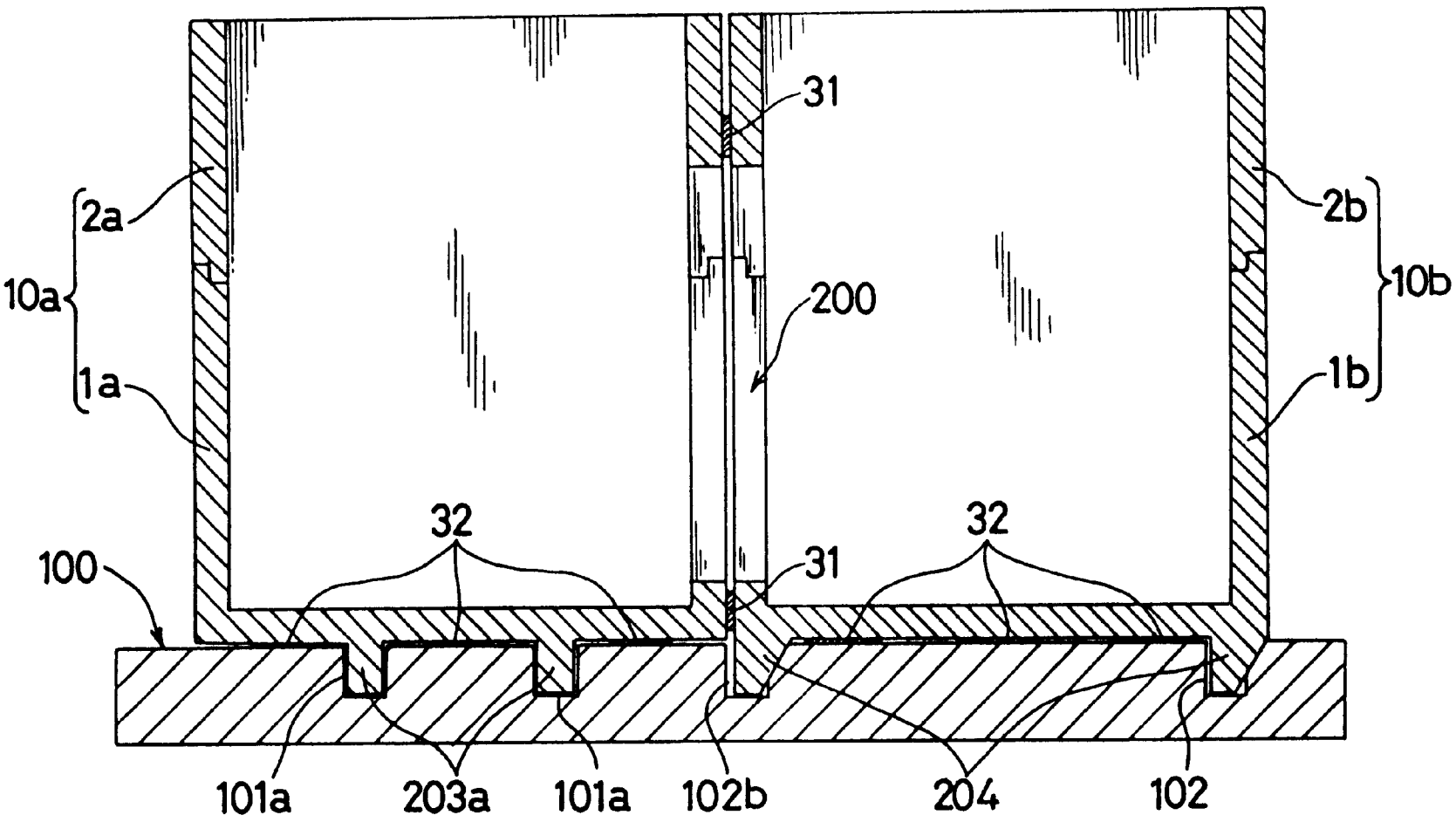
FIG. 18 is a sectional view illustrating one variation of the two-room basement structure of the second embodiment.

FIG. 18 is a sectional view illustrating one variation of the two-room basement structure of the second embodiment. Although the second basement unit 10*b* of this variation is identical to that of the second embodiment, the first basement unit 10*a* has a pair of first bottom projections 203*a* located in a middle part of its bottom, the first bottom projections 203*a* extending parallel to the transverse direction (or at right angles to the page showing FIG. 18). The foundation panel 100 is also modified in that a pair of first retaining grooves 101*a* are formed at locations corresponding to the first bottom projections 203*a*. Further, the foundation panel 100 has, instead of the above-described central retaining groove 103, a fourth retaining groove 102*b* of the same dimensions as the second retaining groove 102 at a location corresponding to the left-hand second bottom projection 204 of the second lower structural block 1*b*. This basement structure is otherwise same as that of the second embodiment and provides the same effects as previously described.

Figure 19:
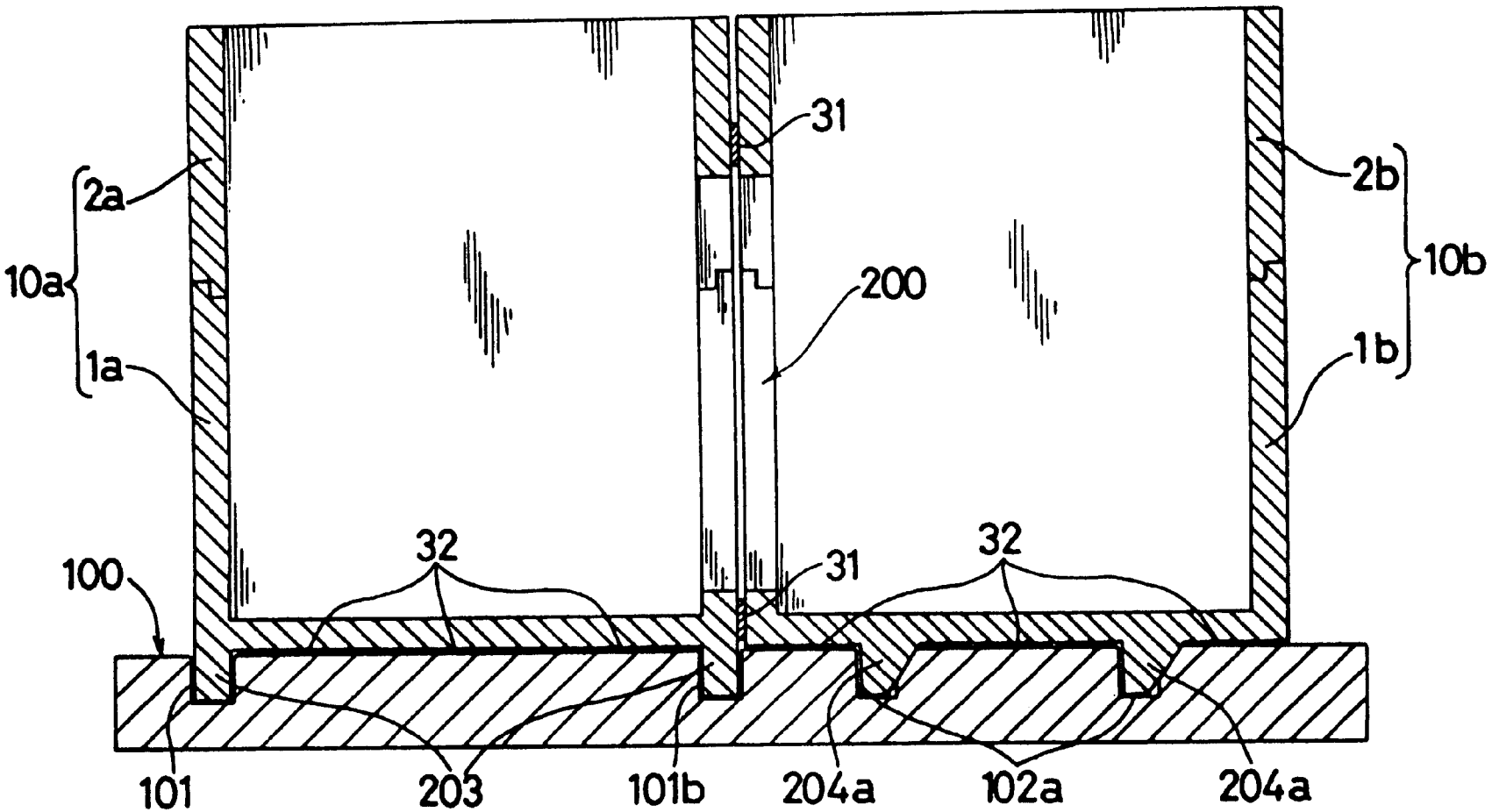
FIG. 19 is a sectional view illustrating another variation of the two-room basement structure of the second embodiment.

FIG. 19 is a sectional view illustrating another variation of the two-room basement structure of the second embodiment. Although the first basement unit 10*a* of this variation is identical to that of the second embodiment, the second basement unit 10*b* has a pair of second bottom projections 204*a* located in a middle part of its bottom, the second bottom projections 204*a* extending parallel to the transverse direction (or at right angles to the page showing FIG. 19). The foundation panel 100 is also modified in that a pair of second retaining grooves 102*a* are formed at locations corresponding to the second bottom projections 204*a*. Further, the foundation panel 100 has, instead of the above-described central retaining groove 103, a fifth retaining groove 101*b* of the same dimensions as the first retaining groove 101 at a location corresponding to the right-hand first bottom projection 203 of the first lower structural block 1*a*. This basement structure is otherwise same as that of the second embodiment and provides the same effects as previously described.

Figure 20:
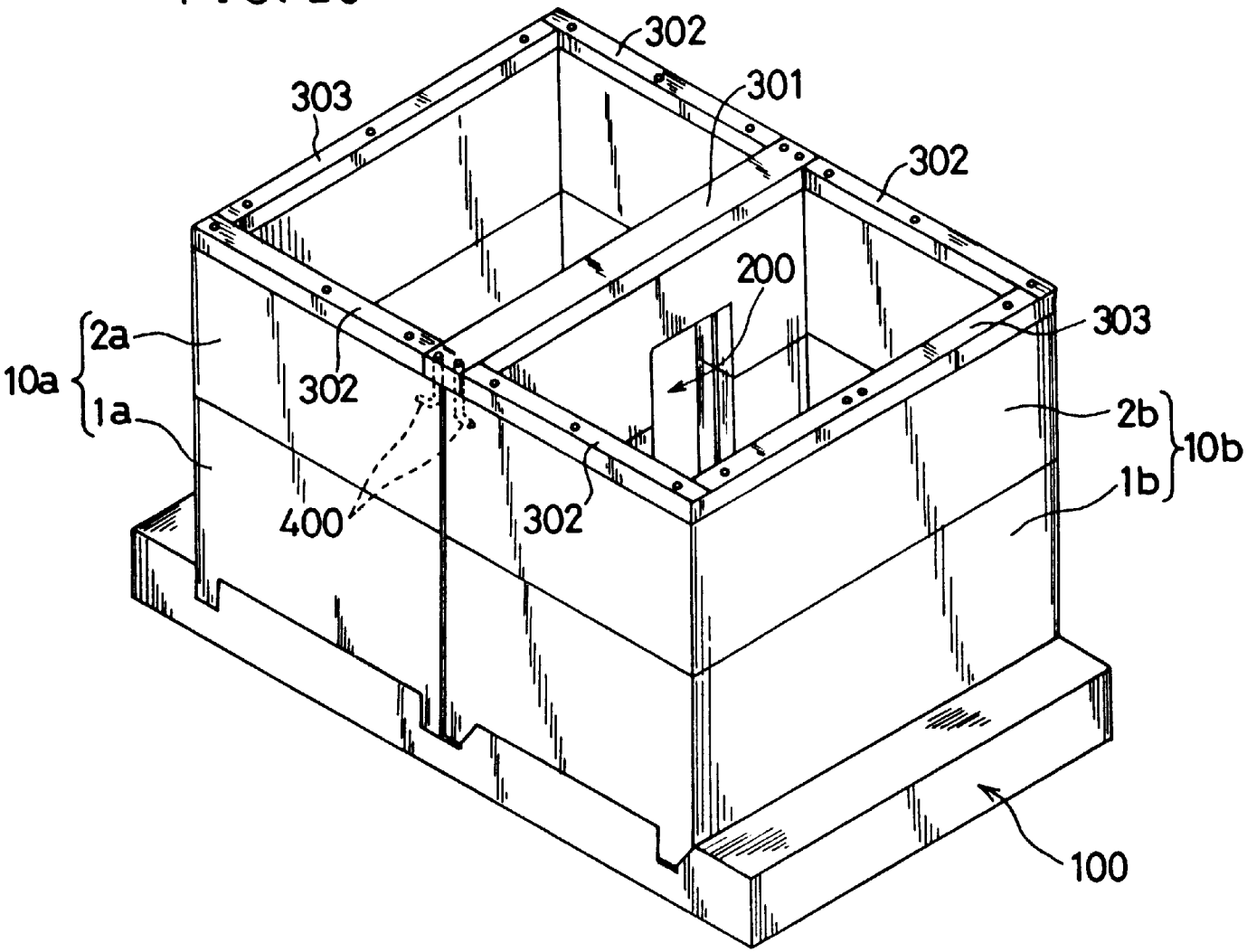
FIG. 20 is a perspective view illustrating the two-room basement structure of the second embodiment finished by fitting header joists to the top of its individual basement units.

FIG. 20 is a perspective view illustrating the two-room basement structure of the second embodiment finished by fitting header joists to the top of the individual basement units 10*a*, 10*b*. As shown in this Figure, the first and second basement units 10*a*, 10*b* are fitted with a connecting header joist 301, four longitudinal header joists 302 and two transverse header joists 303 at the top. The connecting header joist 301 is fixed to the top ends of the facing walls of the first and second basement units 10*a*, 10*b* bridging them together. The longitudinal header joists 302 are fixed to the top ends of those walls of the first and second basement units 10*a*, 10*b* which are parallel to the longitudinal direction, while the transverse header joists 303 are fixed to the top ends of those outside walls which are parallel to the transverse direction.

All these header joists 301–303 have a specific number of bolt holes which are passed over anchor bolts 400 with their heads embedded in the walls of the basement units 10*a*, 10*b* and their threaded parts protruding upward. The header joists 301–303 are secured in place by fitting nuts onto the individual anchor bolts 400. This construction allows a ground-level structure to be built on top of the header joists 301–303. Although the header joists 301–303 used in this embodiment are wooden ones, they may be formed of precast concrete or a synthetic resin material.

As is apparent from the above discussion, it is possible to build a ground-level structure like a house directly on the header joists 301–303, using the first and second basement units 10*a*, 10*b* as a foundation, when the header joists 301–303 are fitted to the individual basement units 10*a*, 10*b* which are mounted on the foundation panel 100. The first and second basement units 10*a*, 10*b* are interconnected by the connecting header joist 301 which bridges their facing walls at the top and by the foundation panel 100 which securely holds their bottom portions. Thus, the first and second basement units 10*a*, 10*b* are joined with each other with increased strength and reliability in the construction shown in FIG. 20.

While the invention has been described with reference to its specific embodiments, it is not limited to the details of the foregoing discussion, but embraces many alternative arrangements and modifications including those described in the following by way of example.

As described earlier in conjunction with the first embodiment, the surrounding walls 12 of the lower structural block 1 have the stepped ends 15 at their top while the surrounding walls 21 of the upper structural block 2 have the stepped ends 24 at their bottom, whereby the stepped ends 15 engage the respective stepped ends 24 when the upper structural block 2 is stacked on top of the lower structural block 1. The provision of such stepped ends 15, 24 is not the only way of implementing the invention. An alternative approach is to produce grooves along the top ends of the surrounding walls 12 of the lower structural block 1 and correspondingly raised ridges along the bottom ends of the surrounding walls 21 of the upper structural block 2, or vice versa. The cross section of these grooves and ridges may be U-shaped, arc-shaped, triangular, or of any other appropriate shape. Another alternative approach is to leave both the top end of each surrounding wall 12 and the bottom end of the surrounding wall 21 flat, without making any stepped shape or groove-and-ridge arrangement.

Although the foregoing embodiments employ the seal member 3 made of a flat rubber strip, the seal member 3 of this invention is not limited to rubber in its material. For example, the seal member 3 may be formed of a synthetic resin material having good flexibility and waterproofing performance. Such seal member 3 may be finished by applying a high-viscosity emulsion consisting mainly of rubber and synthetic resin to its surfaces. A further example is to apply an epoxy adhesive to contact surfaces and use a resultant adhesive layer as the seal member 3.

Waterproofing treatment may be applied to the inside or outside surface or both of the individual walls of the basement unit 10 (10*a*, 10*b*). This would prevent intrusion of groundwater through the surrounding walls 12, 21 in a reliable manner.

Although the basement unit 10 (10*a*, 10*b*) of the foregoing embodiments has a two-layer configuration comprising the lower structural block 1 (1*a*, 1*b*) and the upper structural block 2 ( 2*a*, 2*b*), a configuration comprising three or more blocks stacked one on top of another may be employed in implementing the present invention.

Although each of the bottom projections of the lower structural block 1*a*, 1*b* runs as an elongate one-piece part in the transverse direction of the foundation panel 100 in the second embodiment described above, the bottom projections may be formed in a multi-part configuration, separated along their transverse extension. In this alternative configuration, the retaining grooves may be left in their one-piece form running all the way across the foundation panel 100, or separated in the same way as the corresponding bottom projections.

Although the dimensions of the foundation panel 100 are chosen to accommodate a pair of basement units 10*a*, 10*b* in the second embodiment, foundation panels may be constructed in various sizes including those for a single basement unit and three or more basement units according to the invention.

In another alternative, the second embodiment may be varied in such a way that the first retaining groove 101 in the foundation panel 100 for the first basement unit 10*a* has a slant surface like the second retaining groove 102 ( 102*a*) for the second basement unit 10*b* and the corresponding first bottom projection 203 ( 203*a*) also has a slant surface like the second bottom projection 204 (204*a*). This arrangement will make it easier to mount the first basement unit 10*a* in correct position in the foundation panel 100.

While specific bottom projections and their corresponding retaining grooves have a slant surface inclined to 30 degrees from the vertical in the second embodiment, this inclination may be set to an angle smaller than or larger than 30 degrees if it is desirable.

Although each basement unit 10*a*, 10*b* is constructed by stacking the upper structural block 2*a*, 2*b* on top of the lower structural block 1*a*, 1*b* in the second embodiment, the invention is not limited to such multi-layer configuration. In one variation of the invention, each basement unit can be produced as a one-piece unit.

In a further alternative, friction-reducing cover plates made of steel or synthetic resin may be attached to the slant surfaces 104 and/or the slant surfaces 205. This will reduce friction between the slant surfaces 104 and 205, facilitating their sliding operation.

PRACTICAL EXAMPLE

Figure 21:
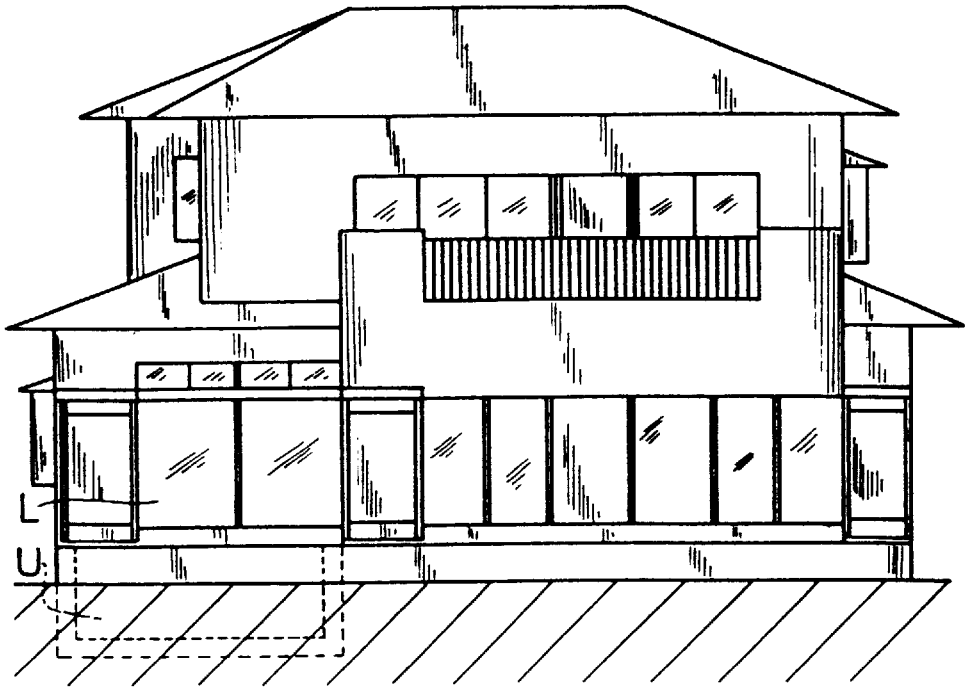
FIG. 21 is an elevational view of a house as viewed from its south side according to one practical example of one-room basement structure of the invention.
Figure 22:
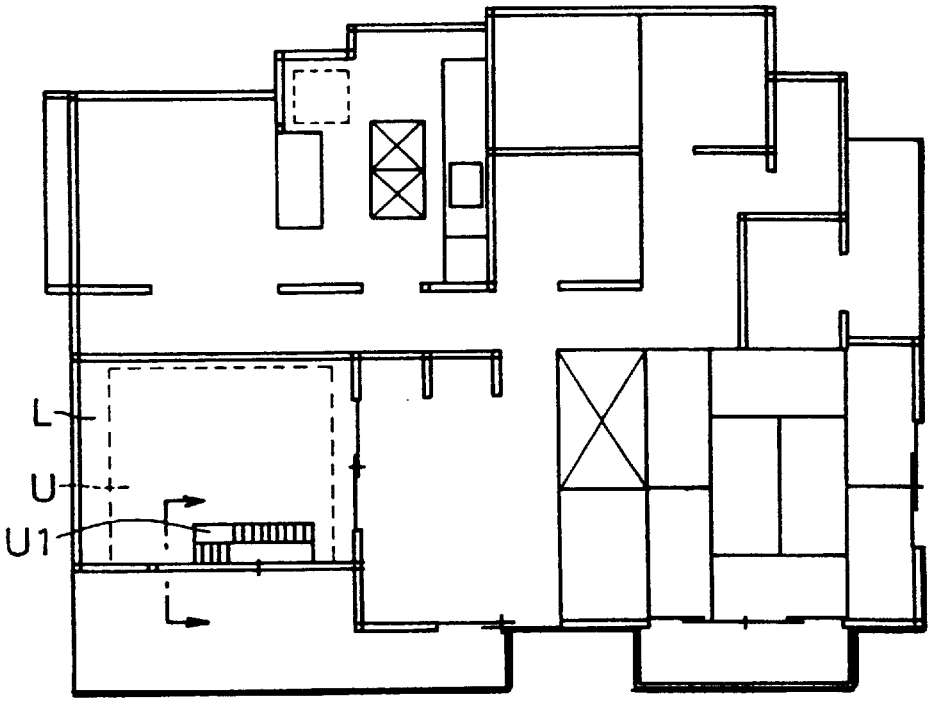
FIG. 22 is a floor plan of the first floor of the house shown in FIG. 21.
Figure 23:
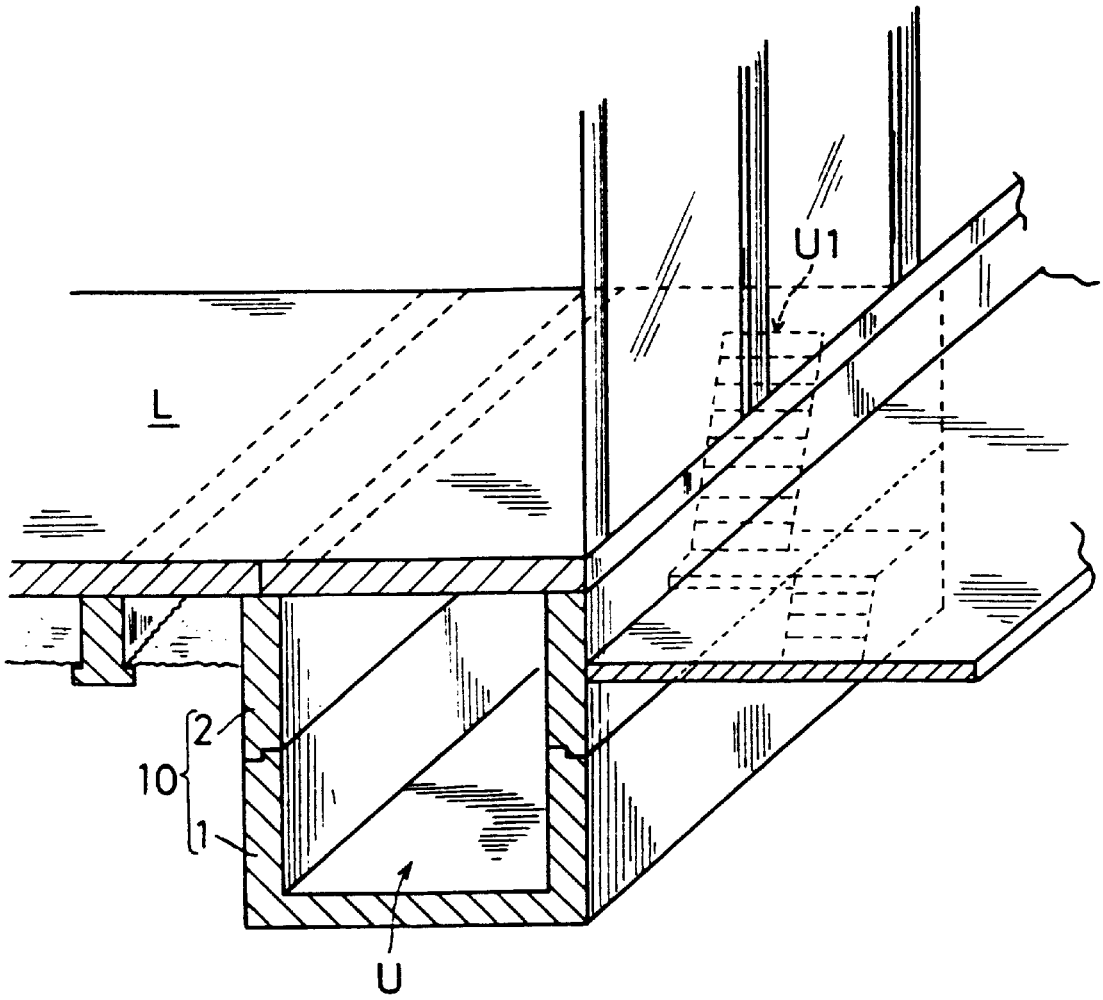
FIG. 23 is a partially sectional perspective view of a basement shown in FIG. 21.

A practical example of a house embodying the basement structure of this invention is now described referring to FIGS. 21 to 25, in which FIG. 21 is an elevational view of the house as viewed from its south side, FIG. 22 is a floor plan of the first floor of the house shown in FIG. 21, and FIG. 23 is a partially sectional perspective view of a basement U shown in FIG. 21. As shown in these Figures, the basement U was constructed of one 6-mat size basement unit 10 of the first embodiment of the invention (Table 1) installed under a south-facing 8-mat living room L of the house. Sliding glass doors, each measuring approximately 1.3 m wide, and a staircase U1 providing access to the basement were mounted on the south side of the living room L to aid in daylighting the basement U.

The basement unit 10 according to the first embodiment of the invention was produced by using high-early-strength Portland cement (JISR5710). The cement was mixed with admixtures including an air entraining and water reducing agent and silica fume and lightweight aggregate materials including fine aggregate and coarse aggregate (MA317) in addition to water to provide enhanced waterproofing and lightweight performance of finished concrete. In this practical example, two types of reinforcing bars F measuring 9 mm and 13 mm in diameter were arranged in each structural block 1, 2 (FIG. 1). The seal member 3 (FIGS. 3A and 3B) formed of a paste-type rubber and asphalt emulsion was placed between the lower structural block 1 and the upper structural block 2. Table 2 below shows detailed characteristics of the concrete.

TABLE 2

| Item | | Unit | Rating |
|---|---|---|---|
| Maximum size of coarse aggregate (crushed stone) | | mm | 15 |
| Slump | | cm | 5–12 |
| Air content | | % | 4–7 |
| Water-cement ratio | | % | 40 |
| Sand percentage | | % | 48 |
| Quantity per unit volume of concrete | Water | kg | 170 |
| | Cement | kg | 425 |
| | Admixtures | kg | 35 |
| | Fine aggregate | kg | 515 |
| | Coarse aggregate | kg | 555 |

It is possible to achieve a compressive strength of 300 kgf/cm$^2$ or above with the concrete to be used for producing the individual structural blocks 1, 2 and a diffusion coefficient (an index representing waterproofing capability) of 10□10$^4$ cm$^2$/sec or less by using the aforementioned materials according to the scheme shown in Table 2. In producing the structural blocks 1, 2 of this practical example in a factory, ready-mixed concrete prepared by mixing the aforementioned materials was poured into the first form 41 and the second form 42, and when three hours had elapsed after placing the concrete, steam was blown into the individual forms 41, 42 to heat the concrete up to 65 ° C. at a rate of 20° C./hour. The concrete was maintained at this temperature for a period of four hours to allow it to set. After the concrete has naturally cooled down to normal temperature, the structural blocks 1, 2 were removed from the forms 41, 42. The structural blocks 1, 2 thus produced were used in this practical example. Table 3 below gives specifications of the structural blocks 1, 2.

TABLE 3

| Item | | Unit | Rating |
|---|---|---|---|
| Dimensions of structural blocks | Wall thickness | mm | 150 |
| | Floor thickness | mm | 150 |
| | Height | mm | 2,400 |
| | Width | mm | 3,030 |
| | Length | mm | 3,940 |
| Weight of structural blocks | Lower block | t | 7.2 |
| | Upper block | t | 4.4 |

Figure 24:
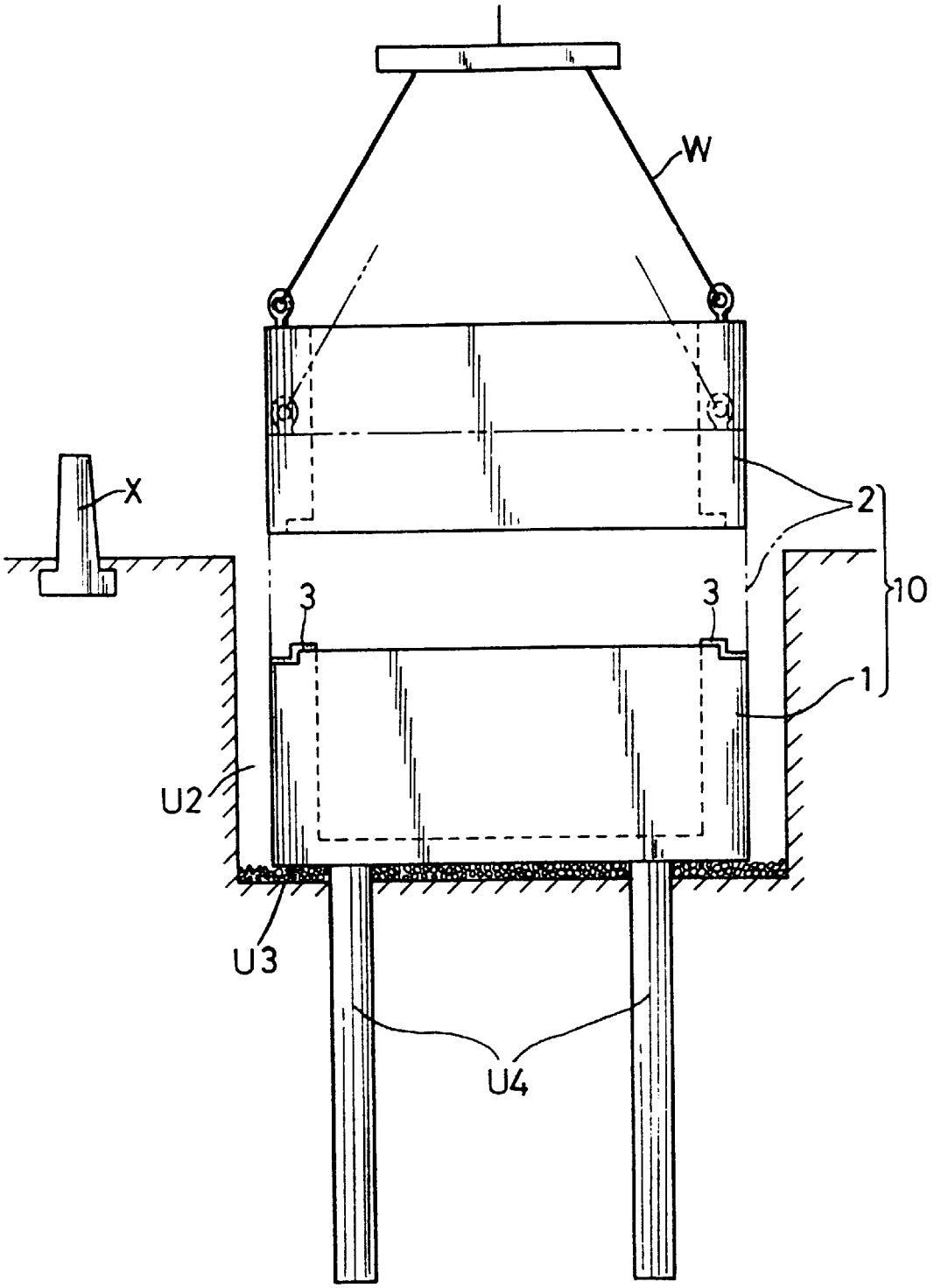
FIG. 24 is a sectional side view illustrating a foundation structure and block mounting work.
Figure 25:
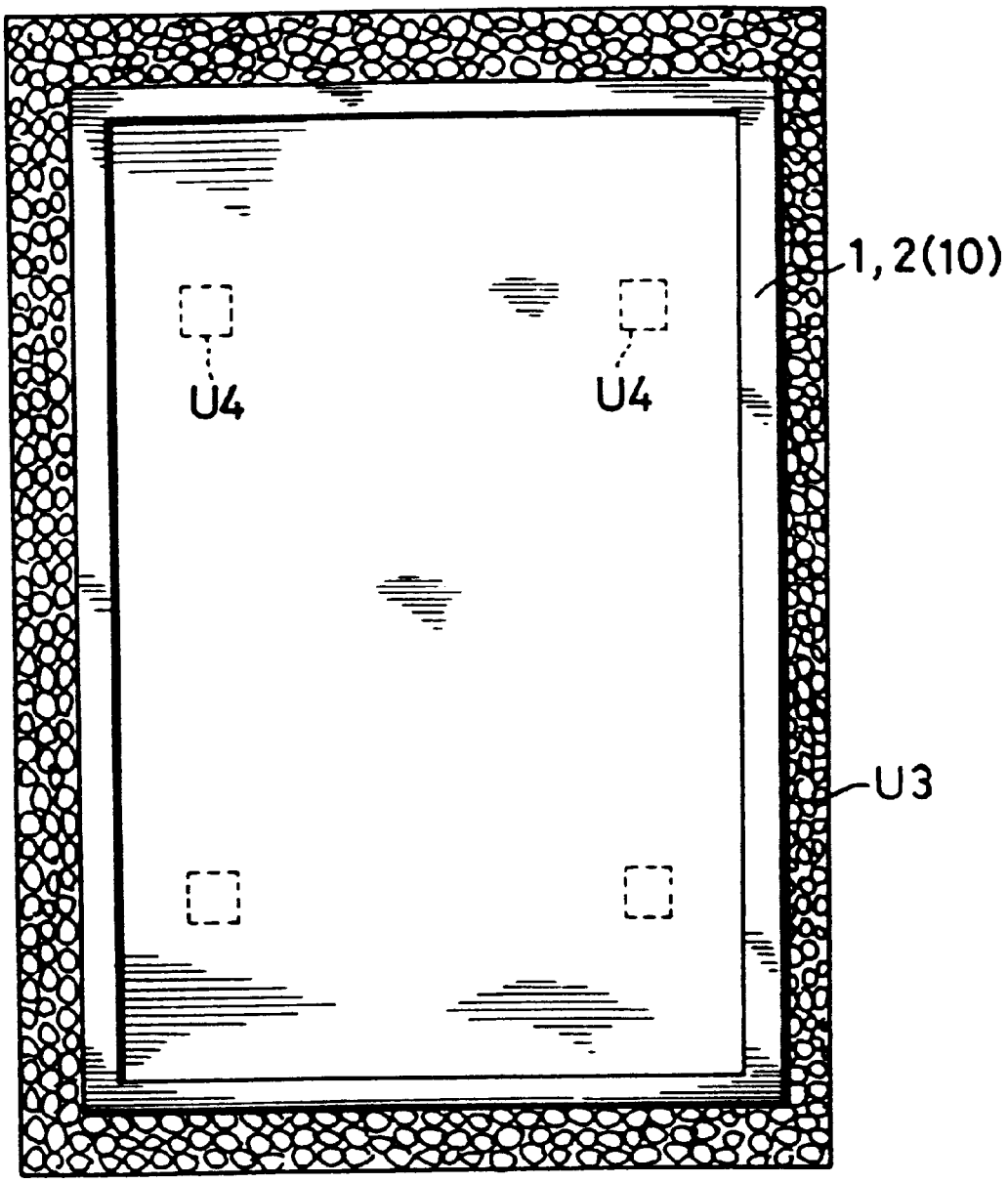
FIG. 25 is a plan view of a pit in which the structural blocks were placed.

The following discussion describes how the individual structural blocks 1, 2 were installed underground in this practical example with reference to FIGS. 24 ad 25, in which FIG. 24 is a sectional side view illustrating a foundation structure and block mounting work, and FIG. 25 is a plan view of a pit U2 in which the structural blocks 1, 2 were placed. The pit U2 of a boxlike shape was excavated using a conventional trench-cutting technique or other appropriate method at a position where the living room L was to be constructed. More specifically, the pit U2 was made on the south side of a foundation wall X of the house that ran in the east-west direction on the north side of the living room L location as shown in FIG. 24. The pit U2 prepared in this example measured 1.9 m deep, 4.5 m long in the east-west direction, and 3.5 m long in the north-south direction.

Four concrete friction piles U4 having a 30□30 cm square cross section were driven into the bottom of the pit U2 with their top portions protruding as high as 10 cm above the bottom of the pit U2 as shown in FIG. 25. Subsequently, crushed stone U3, individual fragments measuring about 40 mm in diameter on average, was deposited on the bottom of the pit U2 and compacted to a thickness of about 10 to form a foundation bed. Since each friction pile U4 of this practical example had a load-bearing capacity of 7.2 tf, the four concrete friction piles U4 provided a total load-bearing capacity of 28.8 tf. Since this load-bearing capacity was more than twice as large as the weight (11.7 tf) of the basement unit 10 of this example, the foundation structure thus produced had the ability to securely prevent differential settlement of the house.

Upon completing the above-described foundation work, the lower structural block 1 was hoisted by a crane and set in place on the bottom of the pit U2. The earlier-mentioned paste-type emulsion was applied to the stepped ends 15 of the lower structural block 1 to a thickness of 30 mm to form the seal member 3. After the seal member 3 had dried, the upper structural block 2 was hoisted by the crane and laid on the lower structural block 1 to form the basement unit 10 in the pit U2 as shown by alternate long and two short dashed lines in FIG. 24. The basement unit 10 protruded approximately 60 cm above the upper edges of the pit U2.

Gaps between the basement unit 10 and the pit U2 were then filled with crushed stone U3 so that the basement unit 10 was concealed underground except for its protruding top portion. Subsequently, the upper opening of the basement unit 10 was covered with a ceiling panel and the staircase U1 which would serve as access to and from the living room L was installed. The interior of the basement unit 10 was then finished to complete the basement U as shown in FIG. 23. The top portion of the basement unit 10 protruding above the ground was used as a foundation for the living room L.

In this practical example, the period of on-site construction work from the mounting of the structural blocks 1, 2 in the pit U2 to the completion of the installation of the ceiling panel was one and one-half days, which was one tenths to one twentieth of the time required for completing a similar basement by the conventional on-site concrete placing technique. This proves that the basement structure of the invention could provide a significant reduction in time and costs required for basement construction.

As described above, a basement structure of the present invention is provided with a reinforced concrete lower structural block having a floor portion and surrounding walls; and at least one reinforced concrete upper structural block having surrounding walls and the same shape as the lower structural block in plan view, the upper structural block being stacked on top of the lower structural block with a seal member placed between the top end of the lower structural block and the bottom end of the upper structural block.

A basement unit is produced by stacking at least one reinforced concrete upper structural block having surrounding walls on top of a reinforced concrete lower structural block having a floor portion and surrounding walls and the same shape as the upper structural block in plan view with a seal member placed between the top end of the lower structural block and the bottom end of the upper structural block.

Each unit can be divided into blocks including one lower structural block and at least one reinforced concrete upper structural block. Accordingly, even large basement unit can be produced in factory, resulting in a significant reduction in on-site construction costs.

Furthermore, the individual structural blocks are stacked with the seal member placed between the top end of the lower structural block and the bottom end of the upper structural block so that their joint area is properly sealed to prevent intrusion of groundwater into the internal space of the basement unit in a reliable manner.

In the conventional basement structure, each basement unit is formed by joining a plurality of horizontally divided, or vertically cut, concrete blocks, which are tied with each other by wires, for example, so that the adjacent concrete blocks would press against each seal member placed between them. Such arrangement of the conventional structure would cause an increase in construction costs and, moreover, the wires binding the concrete blocks would stretch or corrode in a long run, resulting in a reduction in their binding force and eventual deterioration of sealing performance. Compared to this conventional structure, the seal member is permanently pressed by the weight of the overlying upper structural block, without requiring any block-to-block binding device like the wires. This serves to provide a significant reduction in construction costs and prevent intrusion of groundwater for an extended period of time.

The basement structure may be further provided with a platelike foundation panel on which the basement unit is mounted, the foundation panel having at least one retaining groove running parallel to a bottom edge of the basement unit, and the lower structural block having a bottom projection which is so located and shaped as to slide into and fit in position in the retaining groove in the foundation panel.

Since the basement unit is securely mounted on top of the foundation panel in this basement structure, it becomes easier to set the basement unit in its horizontal position and the basement unit is maintained in its correct position in a pit in a more stable manner compared to the structure in which the basement unit is mounted directly on the bottom of the pit. When hoisted by a crane or the like and laid on the foundation panel, the basement unit is properly positioned on the foundation panel as the bottom projection of the basement unit fits into the retaining groove in the foundation panel. Moreover, the basement unit mounted on the foundation panel with the bottom projection and the retaining groove engaged with each other provides an increased resistance to earthquake, especially to vibrations in a horizontal plane.

The retaining groove in the foundation panel is obliquely cut on one side to form a slant surface inclining downward from an upper edge of the retaining groove toward its narrower bottom, and the bottom projection of the basement unit is obliquely cut on its side corresponding to the slant surface of the retaining groove to form a slant surface having the same angle of inclination as the slant surface of the retaining groove.

Since the lower end of the bottom projection has a smaller width than the upper opening of the retaining groove in this structure, the bottom projection can be easily positioned into the retaining groove when mounting the basement unit on the foundation panel. As a result, the bottom projection can be easily aligned with the retaining groove even when the basement unit suspended by the crane swings to a certain extent. Once the bottom projection enters the retaining groove, the slant surface of the bottom projection slides along the slant surface of the retaining groove as the basement unit is lowered until it is set in its correct position on the foundation panel.

The basement structure may be further provided with another basement unit on the foundation panel side by side with the basement unit along a direction intersecting the lengthwise direction of the bottom projection. The two basement units have openings formed in their facing walls and an opening seal member is placed between the facing walls to surround the openings. The slant surface of the retaining groove and the slant surface of the bottom projection are so arranged that the two basement units press against each other with the opening seal member placed in between when the bottom projection is fitted into the retaining groove.

Also, a basement structure of the present invention is provided with a reinforced concrete first basement unit having a floor portion and surrounding walls, a reinforced concrete second basement unit having a floor portion and surrounding walls, a platelike foundation panel on which the first and second basement units are mounted side by side with each other, the foundation panel having at least one retaining groove in which bottom projections formed on the bottom of the first and second basement units can slide and fit in position. The retaining groove is obliquely cut on at least one side to form a slant surface inclining downward from an upper edge of the retaining groove toward its narrower bottom, and at least one of the bottom projections is obliquely cut on its side corresponding to the slant surface of the retaining groove to form a slant surface having the same angle of inclination as the slant surface of the retaining groove. The first and second basement units have openings formed in their facing walls and an opening seal member is placed between the facing walls to surround the openings. The slant surface of the retaining groove and the slant surface of the bottom projection are so arranged that the first and second basement units press against each other with the opening seal member placed in between when the bottom projections are fitted into the retaining groove.

According to the above basement structures, the two basement units come close to each other, guided by the slant surface of the retaining groove, and the opening seal member is tightly pressed against the facing walls of the two basement units when each basement unit is hoisted by a crane or the like and laid on the foundation panel in such a way that the bottom projections fit into the retaining groove. As a consequence, intrusion of groundwater and rainwater into the internal space of each basement unit is prevented in a reliable manner.

The top end of the lower structural block is stepped across its wall thickness and the bottom end of the upper structural block is correspondingly stepped across its wall thickness, whereby the top end of the lower structural block engages with the bottom end of the upper structural block. In this structure, the upper structural block is exactly positioned relative to the lower structural block when they are stacked together, because their facing ends are correspondingly stepped for sure engagement of the two structural blocks.

Alternatively, a groove is formed along one of the facing ends of the lower and upper structural blocks and a correspondingly raised ridge is formed along the other of the facing ends, whereby the ridge fits into the groove so that the lower and upper structural blocks engage with each other. This structure also facilitates correct positioning of the upper structural block relative to the lower structural block when stacking them together.

The seal member is formed of rubber. The use of rubber provides reliable waterproofing of the joint between the lower and upper structural blocks due to its good flexibility and waterproofing performance.

Waterproofing treatment is applied to the inside or outside surface or both of each basement unit. This would prevent intrusion of groundwater through the surrounding walls of the individual structural blocks in a reliable manner.

The lower and upper structural blocks are formed of concrete having a compressive strength of at least 300 $kgf/cm^2$, and the floor portion of the lower structural block and the surrounding walls of the lower and upper structural blocks have a thickness of at least 150 mm. When the basement unit of this structure is installed underground, it will exhibit remarkably high strength so that an upper part of the basement unit can be used as a foundation for a structure constructed above the ground level.

The concrete used for producing the individual structural blocks is mixed with a waterproofing admixture. This would further prevent intrusion of groundwater through the surrounding walls of the structural blocks.

Each of the lower and upper structural blocks measures 2.5 to 3.5 m in width, 0.8 to 1.6 m in height, and 2.5 to 9.0 m in length. The structural blocks thus produced are not only suited for factory production but are convenient for handling and transportation. Further, the structural blocks can be transported by a suitable vehicle to a construction site by public roads.

In a basement unit manufacturing method of the present invention, the lower structural block is produced by arranging reinforcing bars in a first form whose cavity has the same, but inverted, three-dimensional shape as the lower structural block and pouring ready-mixed concrete into the first form, and the upper structural block is produced by arranging reinforcing bars in a second form whose cavity has the same three-dimensional shape as the upper structural block and pouring ready-mixed concrete into the second form.

In this method, the lower and upper structural blocks are produced by placing ready-mixed concrete into their respective forms. It will be appreciated that the lower structural block can be easily removed from the first form when completed because the floor portion of the lower structural block is directed upward in the first form.

In an inventive method of transporting the lower and upper structural blocks of the basement unit, each structural block is turned by 90 degrees so that its longer side wall becomes parallel to a horizontal plane, and each structural block is mounted in a protective rack on a pallet. Thereafter, each rack-mounted structural block is loaded on a vehicle together with the pallet in such a way that the clearance between the bottom of the pallet and the road surface does not exceed 30 cm.

According to this method of transporting the basement unit, each structural block turned by 90 degrees and laid on its side before loading it on the vehicle. This makes it possible to transport the lower and upper structural blocks on the vehicle by public roads in compliance with road traffic laws and regulations with respect to their loaded height and width. Further, each structural block is protected from shocks during transportation as it is housed in the protective rack.

The rack comprises a supporting plate and a frame which is mounted over each structural block placed on the supporting plate and firmly joined to the supporting plate. Using the rack thus constructed, each structural block is first placed on the supporting plate, and the frame is mounted over the structural block. The frame and the supporting plate are then joined together to securely hold the structural block in the rack. With this arrangement, each structural block can be easily mounted in the rack.

In transporting the basement unit, there may be further provided the step of unloading the rack-mounted structural block. The unloading is performed by lifting the rack containing the structural block in an inclined position by using a hoisting device, lowering the rack on a load-receiving device swingably supported on a horizontal shaft, laying the rack on its side by turning the load-receiving device about the horizontal shaft, and removing the rack from the structural block. According to this method, the load-receiving device prevents or alleviates shocks to the rack-mounted structural block during unloading operation.

In an inventive installing method, there are the steps of excavating a vertical pit in the ground which can accommodate at least the lower structural block, forming a stone foundation by depositing crushed stone on the bottom of the pit, placing the lower structural block lifted with its bottom side down on the stone foundation, and placing the upper structural block on top of the lower structural block with the seal member placed between the top end of the lower structural block and the bottom end of the upper structural block, whereby the seal member seals a joint area between the lower and upper structural blocks.

According to this method, the basement structure is installed underground by successively stacking the individual structural blocks in the pit. The stone foundation formed on the bottom of the pit uniformly supports the lower structural block and thereby prevents the basement structure from tilting due to differential settlement, for instance. Further, the seal member placed between the top end of the lower structural block and the bottom end of the upper structural block seals their joint to prevent intrusion of groundwater into the internal space from the joint in a reliable manner.

Further, there may be provided in the installing the step of applying waterproofing lining from inside the basement unit to the joint area between the lower and upper structural blocks where the seal member is placed. Since the joint area is sealed by the waterproofing lining along with the seal member, intrusion of groundwater into the internal space from the joint is prevented in a more reliable manner.

Moreover, there may be provided the step of driving a specified number of friction piles into the bottom of the pit before placing the lower structural block therein. The friction piles further strengthens the stone foundation on the bottom of the pit. This will provide an increased resistance to earthquake and allow an upper part of the basement unit to be used as a foundation which can securely support a structure to be built above the ground.

In another installing method of the present invention, there are provide the steps of excavating a vertical pit in the ground which can accommodate at least the foundation panel, forming a stone foundation by depositing crushed stone on the bottom of the pit, placing the foundation panel lifted with its bottom side down on the stone foundation, placing the lower structural block on the foundation panel in such a way that the bottom projection of the lower structural block fits into the retaining groove in the foundation panel, and placing the upper structural block on top of the lower structural block with the seal member placed between the top end of the lower structural block and the bottom end of the upper structural block, whereby the seal member seals a joint area between the lower and upper structural blocks.

According to this method, the basement structure is installed underground by placing the foundation panel on the stone foundation and then successively stacking the individual structural blocks on the foundation panel. The stone foundation formed on the bottom of the pit uniformly supports the foundation panel. Further, the seal member placed between the top end of the lower structural block and the bottom end of the upper structural block seals their joint to prevent intrusion of groundwater into the internal space from the joint in a reliable manner.

In still another method of installing a basement structure including a pair of basement units side by side with each other on the foundation panel, the bottom projection of one basement unit and its corresponding retaining groove in the foundation panel are formed with respective slant surfaces. Thereby, the basement unit having the bottom projection is positioned in close proximity to the other basement unit when the bottom projection fits into the retaining groove, the two basement units having openings formed in their parallel facing walls. An opening seal member is placed between the facing walls to surround the openings.

According to this installation method, the two basement units come close to each other, guided by the slant surface of the retaining groove, and the opening seal member is tightly pressed against the facing walls of the two basement units when each basement unit is hoisted by a crane or the like and laid on the foundation panel in such a way that the bottom projection fits into the retaining groove. As a consequence, intrusion of groundwater and rainwater into the internal space of each basement unit is prevented in a reliable manner.

In the installation methods, there may be further provided the step of attaching header joists to the top ends of the surrounding walls. This will make it possible to build a structure on the header joists, using the basement unit as a foundation for the structure constructed above the ground level.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A basement structure comprising:

a reinforced concrete first basement unit having a floor portion and surrounding walls;

a reinforced concrete second basement unit having a floor portion and surrounding walls;

a platelike foundation panel on which the first and second basement units are mounted side by side with each other, the foundation panel having at least one retaining groove in which bottom projections formed on the bottom of the first and second basement units can slide and fit in position;

wherein the retaining groove is obliquely cut on at least one side to form a slant surface inclining downward from an upper edge of the retaining groove toward its narrower bottom, and at least one of the bottom projections is obliquely cut on its side corresponding to the slant surface of the retaining groove to form a slant surface having the same angle of inclination as the slant surface of the retaining groove;

wherein the first and second basement units have openings formed in their facing walls and an opening seal member is placed between the facing walls to surround the openings;

and wherein the slant surface of the retaining groove and the slant surface of the bottom projection are so arranged that the first and second basement units press against each other with the opening seal member placed in between when the bottom projections are fitted into the retaining groove.

2. A basement structure comprising:

first and second basement units;

a foundation on which said first and second units are disposed;

said first and second units having a common generally horizontal axis;

preclusion parts on said first unit and said foundation engaging each other so as to preclude translatory movement of said first unit relative to said foundation in a first direction parallel to said axis;

said second unit having a first slanted surface extending at an obtuse angle relative to said axis;

said foundation having a second slanted surface extending at an obtuse angle relative to said axis;

said first slanted surface engaging said second slanted surface such that said engaging slanted surfaces provide a force component to said second unit extending parallel to said axis and directed in said first direction;

said force component urging said second unit in said first direction toward said first unit while said first unit is precluded from translatory movement relative to said foundation in said first direction by said preclusion parts.

3. A basement structure according to claim 2 further comprising a resilient device between said first and second units, said force component urging said second unit towards said first unit to compress said resilient device.

4. A basement structure according to claim 3 wherein said foundation has a groove extending generally perpendicular to said axis said groove having groove side walls, a first one of said groove side walls forming said second slanted surface.

5. A basement structure according to claim 4 wherein said second unit has a projection extending generally perpendicular to said axis, said projection being disposed in said groove, said projection having projection side walls, one of said projection side walls forming said first slanted surface.

6. A basement structure according to claim 5 wherein said projection on said second unit is designated a first projection, said preclusion parts including a second projection on said first unit, said second projection being disposed in said groove, said second projection having second projection side walls, one of said second projections side walls engaging a second one of said groove side walls to preclude translatory movement of said first unit relative to said foundation in said first direction parallel to said axis.

7. A basement structure according to claim 5 wherein said second unit has vertical side walls, said projection extending from one of said side walls.

8. A basement structure according to claim 5 wherein said second unit has a bottom wall, said projection extending from said bottom wall.

9. A basement structure according to claim 2 wherein said second unit has at least one other slanted surface extending at an obtuse angle relative to said axis;

said foundation having at least one other slanted surface extending at an obtuse angle relative to said axis;

said at least one other slanted surface of said second unit engaging said at least one other slanted surface of said foundation such that the last said engaging surfaces provides a second force component to said second unit extending parallel to said axis and directed in said first direction;

said second force component and said first said force component urging said second unit in said first direction toward said first unit which is precluded from translatory movement in said first direction by said preclusion parts.

10. A basement structure according to claim 2 wherein said foundation has the generally configuration of a flat panel.

11. A basement structure according to claim 2 wherein said first and second slanted surfaces are generally flat surfaces.

12. A basement structure according to claim 2 wherein said obtuse angle of said first slanted surface is substantially equal to the obtuse angle of said second slanted surface.

13. A basement structure according to claim 2 wherein said second unit has a bottom wall and said foundation has a top wall, said bottom wall engaging said top wall such that said foundation supports said bottom wall as said force component urges said second unit in said first direction toward said first unit.

14. A basement structure according to claim 2 wherein said first unit has a first general vertical side wall and said second unit has a second generally vertical side wall, said second side wall being urged toward said first side wall by said force component.

15. A basement structure according to claim 14 further comprising a resilient seal between said first and second side walls, said resilient seal being compressed between said first and second side walls as said second side wall is urged toward said first side wall by said force component.

16. A basement structure according to claim 14 wherein said first and second side walls have juxtaposed and aligned openings, and a resilient seal disposed between said first and second side walls and disposed about said aligned openings, said resilient seal being compressed between said first and second side walls as said second side wall is urged toward said first side wall by said force component.

17. A basement structure according to claim 2 wherein said preclusion parts include a projection on said first unit and a groove in said foundation, said projection being received in said groove.

18. A basement structure according to claim 17 wherein said projection and said groove extend in a direction generally perpendicular to said axis.

19. A basement structure according to claim 17 wherein said projection and said groove each have generally vertically side walls.

20. A basement structure comprising:

first and second basement units, at least one of said first and second basement units comprising:

a reinforced concrete lower structural block having a floor portion and surrounding walls; and at least one reinforced concrete upper structural block having surrounding walls and the same shape as the lower structural block in plan view, the upper structural block being stacked on top of the lower structural block with a seal member placed between the top end of the lower structural block and the bottom end of the upper structural block;

a foundation on which said first and second units are disposed;

said first and second units having a common generally horizontal axis;

preclusion parts on said first unit and said foundation to preclude translatory movement of said first unit relative to said foundation in a first parallel to said axis;

said second unit having a first surface extending at an obtuse angle relative to said axis;

said foundation having a second surface extending at an obtuse angle relative to said axis;

said first surface engaging said second surface such that said engaging surfaces provide a force component to said second unit extending parallel to said axis and directed in said first direction;

said force component urging said second unit in said first direction toward said first unit while said first unit is precluded from translatory movement relative to said foundation in said first direction by said preclusion parts.

21. A basement structure according to claim 20, wherein the top end of the lower structural block is stepped across its wall thickness and the bottom end of the upper structural block is correspondingly stepped across its wall thickness, whereby the top end of the lower structural block engages with the bottom end of the upper structural block.

22. A basement structure according to claim 20, wherein a groove is formed along one of the facing ends of the lower and upper structural blocks and a correspondingly raised ridge is formed along the other of the facing ends, whereby the ridge fits into the groove so that the lower and upper structural blocks engage with each other.

23. A basement structure according to claim 20, wherein the seal member is formed of rubber.

24. A basement structure according to claim 20, wherein waterproofing treatment is applied to at least the inside or outside surface of each basement unit.

25. A basement structure according to claim 20, wherein the lower and upper structural blocks are formed of concrete having a compressive strength of at least 300 kgf/cm$^2$, and the floor portion of the lower structural block and the surrounding walls of the lower and upper structural blocks have a thickness of at least 150 mm.

26. A basement structure according to claim 20, wherein the concrete is mixed with a waterproofing admixture.

27. A basement structure according to claim 20, wherein each of the lower and upper structural blocks measures 2.5 to 3.5 m in width, 0.8 to 1.6 m in height, and 2.5 to 9.0 m in length.

28. A basement structure comprising:

first and second basement units;

said first and second units having a common generally horizontal axis;

a foundation on which said first unit is disposed;

said first unit being disposed on said foundation so as to preclude translatory movement of said first unit relative to said foundation in a first direction parallel to said axis;

said second unit having a first slanted surface extending at an obtuse angle relative to said axis;

said foundation having a second slanted surface extending at an obtuse angle relative to said axis;

said first slanted surface engaging said second slanted surface such that said engaging slanted surfaces provide a force component to said second unit extending parallel to said axis and directed in said first direction;

said force component urging said second unit in said first direction toward said first unit while said first unit is precluded from translatory movement relative to said foundation in said first direction.

29. A basement structure comprising:

a first basement unit including:

a reinforced concrete lower structural block having a floor portion and surrounding walls; and at least one reinforced concrete upper structural block having surrounding walls and the same shape as the lower structural block in plan view, the upper structural block being stacked on top of the lower structural block with a seal member placed between the top end of the lower structural block and the bottom end of the upper structural block;

a plate like foundation panel on which the first basement unit is mounted, the foundation panel having at least one retaining groove running parallel to a bottom edge of the first basement unit, and the lower structural block having a bottom projection which is so located and shaped as to slide into and fit in position in the retaining groove in the foundation panel;

the retaining groove being obliquely cut on one side to form a slant surface inclining downwardly from an upper edge of the retaining groove toward its narrower bottom, and the bottom projection is obliquely cut on its side corresponding to the slant surface of the retaining groove to form a slant surface having the same angle of inclination as the slant surface of the retaining groove;

a second basement unit mounted on the foundation panel side by side with the first basement unit along a direction intersecting the lengthwise direction of the bottom projection, wherein the two basement units have openings formed in their facing walls and an opening seal member is placed between the facing walls to surround the openings, and wherein the slant surface of the retaining groove and the slant surface of the bottom projection are so arranged that the two basement units press against each other with the openings seal member placed in between when the bottom projection is fitted into the retaining groove.

* * * * *